US009155174B2

(12) United States Patent
Draper et al.

(10) Patent No.: US 9,155,174 B2
(45) Date of Patent: Oct. 6, 2015

(54) PHASE CONTROL DIMMING COMPATIBLE LIGHTING SYSTEMS

(75) Inventors: William A. Draper, Austin, TX (US); Robert Grisamore, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 388 days.

(21) Appl. No.: 12/570,550

(22) Filed: Sep. 30, 2009

(65) Prior Publication Data

US 2011/0074302 A1 Mar. 31, 2011

(51) Int. Cl.
*H05B 41/36* (2006.01)
*H05B 41/392* (2006.01)

(52) U.S. Cl.
CPC ..... *H05B 41/3924* (2013.01)

(58) Field of Classification Search
USPC ..... 315/98, 224, 247, 291, 307
See application file for complete search history.

(56) References Cited

U.S. PATENT DOCUMENTS

| | | | |
|---|---|---|---|
| 3,316,495 | A | 4/1967 | Sherer |
| 3,423,689 | A | 1/1969 | Miller et al. |
| 3,586,988 | A | 6/1971 | Weekes |
| 3,725,804 | A | 4/1973 | Langan |
| 3,790,878 | A | 2/1974 | Brokaw |
| 3,881,167 | A | 4/1975 | Pelton et al. |
| 4,075,701 | A | 2/1978 | Hofmann |
| 4,334,250 | A | 6/1982 | Theus |
| 4,409,476 | A | 10/1983 | Lofgren et al. |
| 4,414,493 | A | 11/1983 | Henrich |
| 4,476,706 | A | 10/1984 | Hadden et al. |
| 4,523,128 | A | 6/1985 | Stamm et al. |
| 4,677,366 | A | 6/1987 | Wilkinson et al. |
| 4,683,529 | A | 7/1987 | Bucher |
| 4,700,188 | A | 10/1987 | James |
| 4,737,658 | A | 4/1988 | Kronmuller et al. |
| 4,797,633 | A | 1/1989 | Humphrey |
| 4,937,728 | A | 6/1990 | Leonardi |

(Continued)

FOREIGN PATENT DOCUMENTS

| | | | |
|---|---|---|---|
| CN | 1459216 | A | 11/2004 |
| CN | 1843061 | A1 | 10/2006 |

(Continued)

OTHER PUBLICATIONS

Infineon, CCM-PFC Standalone Power Factor Correction (PFC) Controller in Continuous Conduction Mode (CCM), Version 2.1, Feb. 6, 2007.

(Continued)

*Primary Examiner* — Douglas W Owens
*Assistant Examiner* — Jonathan Cooper
(74) *Attorney, Agent, or Firm* — Terrile, Cannatti, Chambers & Holland, LLP; Kent B. Chambers

(57) ABSTRACT

A power control/lighting system includes a controller to provide compatibility between a lamp ballast configured to receive a dedicated dimmer signal and a phase control dimmer. In at least one embodiment, the controller converts a phase control dimming signal into dimming information useable by a lamp ballast of a gas discharge lamp based lighting system. Additionally, in at least one embodiment, the controller also controls power factor correction of the power control/lighting system. In at least one embodiment, the controller provides dimming information based on the phase control dimming signal that allows the lamp ballast to be used in conjunction with a phase control dimmer.

30 Claims, 9 Drawing Sheets

(56) References Cited

U.S. PATENT DOCUMENTS 4,940,929 A 7/1990 Williams
4,973,919 A 11/1990 Allfather
4,979,087 A 12/1990 Sellwood et al.
4,980,898 A 12/1990 Silvian
4,992,919 A 2/1991 Lee et al.
4,994,952 A 2/1991 Silva et al.
5,001,620 A 3/1991 Smith
5,055,746 A 10/1991 Hu et al.
5,109,185 A 4/1992 Ball
5,121,079 A 6/1992 Dargatz
5,179,324 A 1/1993 Aubert
5,206,540 A 4/1993 de Sa e Silva et al.
5,264,780 A 11/1993 Bruer et al.
5,278,490 A 1/1994 Smedley
5,319,301 A 6/1994 Callahan et al.
5,321,350 A 6/1994 Haas
5,323,157 A 6/1994 Ledzius et al.
5,359,180 A 10/1994 Park et al.
5,383,109 A 1/1995 Maksimovic et al.
5,424,932 A 6/1995 Inou et al.
5,477,481 A 12/1995 Kerth
5,479,333 A 12/1995 McCambridge et al.
5,481,178 A 1/1996 Wilcox et al.
5,565,761 A 10/1996 Hwang
5,589,759 A 12/1996 Borgato et al.
5,604,411 A 2/1997 Venkitasubrahmanian
5,629,607 A 5/1997 Callahan et al.
5,638,265 A 6/1997 Gabor
5,661,645 A 8/1997 Hochstein
5,691,605 A 11/1997 Xia et al.
5,691,890 A 11/1997 Hyde
5,747,977 A 5/1998 Hwang
5,757,635 A 5/1998 Seong
5,764,039 A 6/1998 Choi et al.
5,768,111 A 6/1998 Zaitsu
5,770,928 A 6/1998 Chansky et al.
5,781,040 A 7/1998 Myers
5,783,909 A 7/1998 Hochstein
5,798,635 A 8/1998 Hwang et al.
5,900,683 A 5/1999 Rinehart et al.
5,912,812 A 6/1999 Moriarty, Jr.
5,929,400 A 7/1999 Colby et al.
5,946,202 A 8/1999 Balogh
5,946,206 A 8/1999 Shimizu et al.
5,952,849 A 9/1999 Haigh et al.
5,960,207 A 9/1999 Brown
5,962,989 A 10/1999 Baker
5,963,086 A 10/1999 Hall
5,966,297 A 10/1999 Minegishi
5,994,885 A 11/1999 Wilcox et al.
6,016,038 A 1/2000 Mueller et al.
6,043,633 A 3/2000 Lev et al.
6,043,635 A 3/2000 Downey
6,046,550 A 4/2000 Ference et al.
6,072,969 A 6/2000 Yokomori et al.
6,083,276 A 7/2000 Davidson et al.
6,084,450 A 7/2000 Smith et al.
6,091,205 A 7/2000 Newman et al.
6,091,233 A 7/2000 Hwang
6,125,046 A 9/2000 Jang et al.
6,150,774 A 11/2000 Mueller et al.
6,181,114 B1 1/2001 Hemena et al.
6,211,624 B1 4/2001 Holzer
6,211,626 B1 4/2001 Lys et al.
6,211,627 B1 4/2001 Callahan
6,229,271 B1 5/2001 Liu
6,229,292 B1 5/2001 Redl et al.
6,246,183 B1 6/2001 Buonavita
6,259,614 B1 7/2001 Ribarich et al.
6,300,723 B1 10/2001 Wang et al.
6,304,066 B1 10/2001 Wilcox et al.
6,304,473 B1 10/2001 Telefus et al.
6,343,026 B1 1/2002 Perry
6,344,811 B1 2/2002 Melanson
6,369,525 B1 4/2002 Chang et al.
6,380,692 B1 4/2002 Newman et al.
6,385,063 B1 5/2002 Sadek et al.
6,407,514 B1 6/2002 Glaser et al.
6,407,515 B1 6/2002 Hesler
6,407,691 B1 6/2002 Yu
6,441,558 B1 8/2002 Muthu et al.
6,445,600 B2 9/2002 Ben-Yaakov
6,452,521 B1 9/2002 Wang
6,469,484 B2 10/2002 L'Hermite et al.
6,495,964 B1 12/2002 Muthu et al.
6,509,913 B2 1/2003 Martin, Jr. et al.
6,531,854 B2 3/2003 Hwang
6,580,258 B2 6/2003 Wilcox et al.
6,583,550 B2 6/2003 Iwasa et al.
6,621,256 B2 9/2003 Muratov et al.
6,628,106 B1 9/2003 Batarseh et al.
6,636,003 B2 10/2003 Rahm et al.
6,646,848 B2 11/2003 Yoshida et al.
6,657,417 B1 12/2003 Hwang
6,688,753 B2 2/2004 Calon et al.
6,713,974 B2 3/2004 Patchornik et al.
6,714,425 B2 3/2004 Yamada et al.
6,724,174 B1 4/2004 Esteves et al.
6,727,832 B1 4/2004 Melanson
6,737,845 B2 5/2004 Hwang
6,741,123 B1 5/2004 Anderson et al.
6,753,661 B2 6/2004 Muthu et al.
6,756,772 B2 6/2004 McGinnis
6,768,655 B1 7/2004 Yang et al.
6,781,351 B2 8/2004 Mednik et al.
6,788,011 B2 9/2004 Mueller et al.
6,806,659 B1 10/2004 Mueller et al.
6,839,247 B1 1/2005 Yang
6,858,995 B2 2/2005 Lee et al.
6,860,628 B2 3/2005 Robertson et al.
6,870,325 B2 3/2005 Bushell et al.
6,873,065 B2 3/2005 Haigh et al.
6,882,552 B2 4/2005 Telefus et al.
6,888,322 B2 5/2005 Dowling et al.
6,894,471 B2 5/2005 Corva et al.
6,900,599 B2 * 5/2005 Ribarich ..... 315/247
6,933,706 B2 8/2005 Shih
6,940,733 B2 9/2005 Schie et al.
6,944,034 B1 9/2005 Shteynberg et al.
6,956,750 B1 10/2005 Eason et al.
6,958,920 B2 10/2005 Mednik et al.
6,963,496 B2 11/2005 Bimbaud
6,967,448 B2 11/2005 Morgan et al.
6,970,503 B1 11/2005 Kalb
6,975,079 B2 12/2005 Lys et al.
6,975,523 B2 12/2005 Kim et al.
6,980,446 B2 12/2005 Simada et al.
7,003,023 B2 2/2006 Krone et al.
7,034,611 B2 4/2006 Oswal et al.
7,050,509 B2 5/2006 Krone et al.
7,064,498 B2 6/2006 Dowling et al.
7,064,531 B1 6/2006 Zinn
7,072,191 B2 7/2006 Nakao et al.
7,075,329 B2 7/2006 Chen et al.
7,078,963 B1 7/2006 Andersen et al.
7,088,059 B2 8/2006 McKinney et al.
7,099,163 B1 8/2006 Ying
7,102,902 B1 9/2006 Brown et al.
7,106,603 B1 9/2006 Lin et al.
7,109,791 B1 9/2006 Epperson et al.
7,126,288 B2 10/2006 Ribarich et al.
7,135,824 B2 11/2006 Lys et al.
7,145,295 B1 12/2006 Lee et al.
7,158,633 B1 1/2007 Hein
7,161,816 B2 1/2007 Shteynberg et al.
7,180,250 B1 2/2007 Gannon
7,183,957 B1 2/2007 Melanson
7,184,937 B1 2/2007 Su et al.
7,221,130 B2 5/2007 Ribeiro et al.
7,233,135 B2 6/2007 Noma et al.
7,246,919 B2 7/2007 Porchia et al.
7,255,457 B2 8/2007 Ducharm et al.
7,266,001 B1 9/2007 Notohamiprodjo et al.
7,276,861 B1 10/2007 Shteynberg et al.

(56) References Cited

U.S. PATENT DOCUMENTS 7,288,902 B1 10/2007 Melanson
7,292,013 B1 11/2007 Chen et al.
7,310,244 B2 12/2007 Yang et al.
7,339,329 B2 3/2008 Makimura et al.
7,345,458 B2 3/2008 Kanai et al.
7,375,476 B2 5/2008 Walter et al.
7,388,764 B2 6/2008 Huynh et al.
7,394,210 B2 7/2008 Ashdown
7,511,437 B2 3/2009 Lys et al.
7,538,499 B2 5/2009 Ashdown
7,545,130 B2 6/2009 Latham
7,554,473 B2 6/2009 Melanson
7,569,996 B2 8/2009 Holmes et al.
7,583,136 B2 9/2009 Pelly
7,656,103 B2 2/2010 Shteynberg et al.
7,667,986 B2 2/2010 Artusi et al.
7,710,047 B2 5/2010 Shteynberg et al.
7,719,246 B2 5/2010 Melanson
7,719,248 B1 5/2010 Melanson
7,728,530 B2 6/2010 Wang et al.
7,733,678 B1 6/2010 Notohamiprodjo et al.
7,746,043 B2 6/2010 Melanson
7,746,671 B2 6/2010 Radecker et al.
7,750,580 B2 7/2010 Lu et al.
7,750,738 B2 7/2010 Bach
7,756,896 B1 7/2010 Feingold
7,759,881 B1 7/2010 Melanson
7,777,563 B2 8/2010 Midya et al.
7,786,711 B2 8/2010 Wei et al.
7,804,256 B2 9/2010 Melanson
7,804,480 B2 9/2010 Jeon et al.
7,872,427 B2 1/2011 Scianna
7,982,415 B2 7/2011 Kimura
8,102,167 B2 1/2012 Irissou et al.
8,115,419 B2 2/2012 Given et al.
8,169,154 B2 5/2012 Thompson et al.
8,212,491 B2 7/2012 Kost
8,212,492 B2 7/2012 Lam et al.
8,222,832 B2 7/2012 Zheng et al.
8,482,220 B2 7/2013 Melanson
8,487,546 B2 7/2013 Melanson
8,536,794 B2 9/2013 Melanson et al.
8,536,799 B1 9/2013 Grisamore et al.
8,547,034 B2 10/2013 Melanson et al.
8,569,972 B2 10/2013 Melanson
8,581,518 B2 11/2013 Kuang et al.
8,610,364 B2 12/2013 Melanson et al.
8,610,365 B2 12/2013 King et al.
8,664,885 B2 3/2014 Koolen et al.
8,749,173 B1 6/2014 Melanson et al.
8,847,515 B2 9/2014 King et al.
2002/0065583 A1 5/2002 Okada
2002/0140371 A1* 10/2002 Chou et al. ..... 315/224
2002/0145041 A1 10/2002 Muthu et al.
2002/0150151 A1 10/2002 Krone et al.
2002/0166073 A1 11/2002 Nguyen et al.
2003/0095013 A1 5/2003 Melanson et al.
2003/0174520 A1 9/2003 Bimbaud
2003/0223255 A1 12/2003 Ben-Yaakov
2004/0004465 A1 1/2004 McGinnis
2004/0046683 A1 3/2004 Mitamura et al.
2004/0085030 A1 5/2004 Laflamme et al.
2004/0085117 A1 5/2004 Melbert et al.
2004/0105283 A1 6/2004 Schie et al.
2004/0169477 A1 9/2004 Yancie et al.
2004/0212321 A1 10/2004 Lys
2004/0227571 A1 11/2004 Kuribayashi
2004/0228116 A1 11/2004 Miller et al.
2004/0232971 A1 11/2004 Kawasaki et al.
2004/0239262 A1 12/2004 Ido et al.
2005/0057237 A1 3/2005 Clavel
2005/0156770 A1 7/2005 Melanson
2005/0168492 A1 8/2005 Hekstra et al.
2005/0184895 A1 8/2005 Petersen et al.
2005/0197952 A1 9/2005 Shea et al.
2005/0207190 A1 9/2005 Gritter
2005/0218838 A1 10/2005 Lys
2005/0222881 A1 10/2005 Booker
2005/0253533 A1 11/2005 Lys et al.
2005/0270813 A1 12/2005 Zhang et al.
2005/0275354 A1 12/2005 Hausman, Jr. et al.
2005/0275386 A1 12/2005 Jepsen et al.
2006/0002110 A1 1/2006 Dowling
2006/0022916 A1 2/2006 Aiello
2006/0023002 A1 2/2006 Hara et al.
2006/0116898 A1 6/2006 Peterson
2006/0125420 A1 6/2006 Boone et al.
2006/0184414 A1 8/2006 Pappas et al.
2006/0208669 A1 9/2006 Huynh et al.
2006/0214603 A1 9/2006 Oh et al.
2006/0226795 A1 10/2006 Walter et al.
2006/0238136 A1 10/2006 Johnson, III et al.
2006/0261754 A1 11/2006 Lee
2006/0285365 A1 12/2006 Huynh et al.
2007/0024213 A1 2/2007 Shteynberg et al.
2007/0029946 A1 2/2007 Yu et al.
2007/0040512 A1 2/2007 Jungwirth et al.
2007/0053182 A1 3/2007 Robertson
2007/0055564 A1 3/2007 Fourman
2007/0103949 A1 5/2007 Tsuruya
2007/0124615 A1 5/2007 Orr
2007/0126656 A1 6/2007 Huang et al.
2007/0182338 A1 8/2007 Shteynberg
2007/0182347 A1 8/2007 Shteynberg
2007/0182699 A1 8/2007 Ha et al.
2007/0285031 A1 12/2007 Shteynberg et al.
2008/0012502 A1 1/2008 Lys
2008/0018261 A1 1/2008 Kastner
2008/0027841 A1 1/2008 Eder
2008/0043504 A1 2/2008 Ye et al.
2008/0054815 A1 3/2008 Kotikalapoodi et al.
2008/0116818 A1 5/2008 Shteynberg et al.
2008/0130322 A1 6/2008 Artusi et al.
2008/0130336 A1 6/2008 Taguchi
2008/0143266 A1 6/2008 Langer
2008/0150433 A1 6/2008 Tsuchida et al.
2008/0154679 A1 6/2008 Wade
2008/0174291 A1 7/2008 Hansson et al.
2008/0174372 A1 7/2008 Tucker et al.
2008/0175029 A1 7/2008 Jung et al.
2008/0192509 A1 8/2008 Dhuyvetter et al.
2008/0203934 A1 8/2008 VanMeurs
2008/0205103 A1 8/2008 Sutardja et al.
2008/0224629 A1* 9/2008 Melanson ..... 315/247
2008/0224633 A1* 9/2008 Melanson et al. ..... 315/292
2008/0224635 A1 9/2008 Hayes
2008/0224636 A1* 9/2008 Melanson ..... 315/307
2008/0232141 A1 9/2008 Artusi et al.
2008/0239764 A1 10/2008 Jacques et al.
2008/0259655 A1 10/2008 Wei et al.
2008/0278132 A1 11/2008 Kesterson et al.
2009/0067204 A1 3/2009 Ye et al.
2009/0070188 A1 3/2009 Scott et al.
2009/0134817 A1 5/2009 Jurngwirth et al.
2009/0147544 A1 6/2009 Melanson
2009/0174479 A1 7/2009 Yan et al.
2009/0195186 A1 8/2009 Guest et al.
2009/0218960 A1 9/2009 Lyons et al.
2009/0284182 A1 11/2009 Cencur
2010/0002480 A1 1/2010 Huynh et al.
2010/0013405 A1 1/2010 Thompson et al.
2010/0013409 A1 1/2010 Quek et al.
2010/0066328 A1 3/2010 Shimizu et al.
2010/0141317 A1 6/2010 Szajnowski
2010/0164406 A1 7/2010 Kost et al.
2010/0213859 A1 8/2010 Shteynberg et al.
2010/0231136 A1 9/2010 Reisenbauer et al.
2010/0244726 A1 9/2010 Melanson
2011/0043133 A1 2/2011 Van Laanen et al.
2011/0080110 A1 4/2011 Nuhfer et al.
2011/0084622 A1 4/2011 Barrow et al.
2011/0084623 A1 4/2011 Barrow
2011/0115395 A1 5/2011 Barrow et al.
2011/0121754 A1 5/2011 Shteynberg

(56) References Cited

U.S. PATENT DOCUMENTS

| | | | |
|---|---|---|---|
| 2011/0148318 | A1 | 6/2011 | Shackle et al. |
| 2011/0204797 | A1 | 8/2011 | Lin et al. |
| 2011/0204803 | A1 | 8/2011 | Grotkowski et al. |
| 2011/0234115 | A1 | 9/2011 | Shimizu et al. |
| 2011/0266968 | A1 | 11/2011 | Bordin et al. |
| 2011/0291583 | A1 | 12/2011 | Shen |
| 2011/0309759 | A1 | 12/2011 | Shteynberg et al. |
| 2011/0316441 | A1 | 12/2011 | Huynh |
| 2012/0049752 | A1 | 3/2012 | King et al. |
| 2012/0068626 | A1 | 3/2012 | Lekatsas et al. |
| 2012/0098454 | A1 | 4/2012 | Grotkowski et al. |
| 2012/0133291 | A1 | 5/2012 | Kitagawa et al. |
| 2012/0286686 | A1 | 11/2012 | Watanabe et al. |
| 2013/0015768 | A1 | 1/2013 | Roberts et al. |
| 2013/0154495 | A1 | 6/2013 | He |
| 2013/0193879 | A1 | 8/2013 | Sadwick et al. |
| 2014/0009082 | A1 | 1/2014 | King et al. |

FOREIGN PATENT DOCUMENTS

| | | | |
|---|---|---|---|
| CN | 101164383 | A | 4/2008 |
| CN | 101505568 | A | 8/2009 |
| DE | 19713814 | | 10/1998 |
| EP | 0585789 | A1 | 3/1994 |
| EP | 0632679 | | 1/1995 |
| EP | 0838791 | | 4/1998 |
| EP | 0910168 | A1 | 4/1999 |
| EP | 1014563 | | 6/2000 |
| EP | 1164819 | A | 12/2001 |
| EP | 1213823 | A2 | 6/2002 |
| EP | 1460775 | | 9/2004 |
| EP | 1528785 | A | 5/2005 |
| EP | 2257124 | A1 | 1/2010 |
| EP | 2204905 Al | | 7/2010 |
| EP | 2232949 | | 9/2010 |
| GB | 2069269 | A | 8/1981 |
| JP | WO 2006/022107 | A2 | 3/2006 |
| JP | 2008053181 | A | 3/2008 |
| JP | 2009170240 | A | 7/2009 |
| WO | WO9725836 | | 7/1997 |
| WO | 9917591 | | 4/1999 |
| WO | 01/15316 | A1 | 1/2001 |
| WO | 01/97384 | A | 12/2001 |
| WO | 02/15386 | A2 | 2/2002 |
| WO | WO0227944 | | 4/2002 |
| WO | 02/091805 | A2 | 11/2002 |
| WO | 02096162 | | 11/2002 |
| WO | WO2006013557 | | 2/2006 |
| WO | 2006/067521 | A | 6/2006 |
| WO | 2006079937 | | 8/2006 |
| WO | WO2006135584 | | 12/2006 |
| WO | 2007/026170 | A | 3/2007 |
| WO | 2007/079362 | A | 7/2007 |
| WO | 2008029108 | | 3/2008 |
| WO | WO2008072160 | | 6/2008 |
| WO | 2008112822 | A2 | 9/2008 |
| WO | WO2008152838 | | 12/2008 |
| WO | 2010011971 | A1 | 1/2010 |
| WO | 2010027493 | A2 | 3/2010 |
| WO | 2010035155 | A2 | 4/2010 |
| WO | 2011008635 | A1 | 1/2011 |
| WO | 2011050453 | A1 | 5/2011 |
| WO | 2011056068 | A2 | 5/2011 |
| WO | 2012016197 | A1 | 2/2012 |

OTHER PUBLICATIONS

International Rectifier, IRAC1150-300W Demo Board, User's Guide, Rev 3.0, Aug. 2, 2005.
International Rectifier, Application Note AN-1077,PFC Converter Design with IR1150 One Cycle Control IC, rev. 2.3, Jun. 2005.
International Rectifier, Data Sheet PD60230 revC, Feb. 5, 2007.
Lu et al., International Rectifier, Bridgeless PFC Implementation Using One Cycle Control Technique, 2005.
Linear Technology, LT1248, Power Factor Controller, Apr. 20, 2007.
ON Semiconductor, AND8123/D, Power Factor Correction Stages Operating in Critical Conduction Mode, Sep. 2003.
ON Semiconductor, MC33260, GreenLine Compact Power Factor Controller: Innovative Circuit for Cost Effective Solutions, Sep. 2005.
ON Semiconductor, NCP1605, Enhanced, High Voltage and Efficient Standby Mode, Power Factor Controller, Feb. 2007.
ON Semconductor, NCP1606, Cost Effective Power Factor Controller, Mar. 2007.
ON Semiconductor, NCP1654, Product Review, Power Factor Controller for Compact and Robust, Continuous Conduction Mode Pre-Converters, Mar. 2007.
Philips, Application Note, 90W Resonant SMPS with TEA1610 SwingChip, AN99011, 1999.
NXP, TEA1750, GreenChip III SMPS control IC Product Data Sheet, Apr. 6, 2007.
Renesas, HA16174P/FP, Power Factor Correction Controller IC, Jan. 6, 2006.
Renesas Technology Releases Industry's First Critical-Conduction-Mode Power Factor Correction Control IC Implementing Interleaved Operation, Dec. 18, 2006.
Renesas, Application Note R2A20111 EVB, PFC Control IC R2A20111 Evaluation Board, Feb. 2007.
STMicroelectronics, L6563, Advanced Transition-Mode PFC Controller, Mar. 2007.
Texas Instruments, Application Note SLUA321, Startup Current Transient of the Leading Edge Triggered PFC Controllers, Jul. 2004.
Texas Instruments, Application Report, SLUA309A, Avoiding Audible Noise at Light Loads when using Leading Edge Triggered PFC Converters, Sep. 2004.
Texas Instruments, Application Report SLUA369B, 350-W, Two-Phase Interleaved PFC Pre-Regulator Design Review, Mar. 2007.
Unitrode, High Power-Factor Preregulator, Oct. 1994.
Texas Instruments, Transition Mode PFC Controller, SLUS515D, Jul. 2005.
Unitrode Products From Texas Instruments, Programmable Output Power Factor Preregulator, Dec. 2004.
Unitrode Products From Texas Instruments, High Performance Power Factor Preregulator, Oct. 2005.
Texas Instruments, UCC3817 BiCMOS Power Factor Preregulator Evaluation Board User's Guide, Nov. 2002.
Unitrode, L. Balogh, Design Note UC3854A/B and UC3855A/B Provide Power Limiting with Sinusoidal Input Current for PFC Front Ends, SLUA196A, Nov. 2001.
A. Silva De Morais et al., A High Power Factor Ballast Using a Single Switch with Both Power Stages Integrated, IEEE Transactions on Power Electronics, vol. 21, No. 2, Mar. 2006.
M. Ponce et al., High-Efficient Integrated Electronic Ballast for Compact Fluorescent Lamps, IEEE Transactions on Power Electronics, vol. 21, No. 2, Mar. 2006.
A. R. Seidel et al., A Practical Comparison Among High-Power-Factor Electronic Ballasts with Similar Ideas, IEEE Transactions on Industry Applications, vol. 41, No. 6, Nov.-Dec. 2005.
F. T. Wakabayashi et al., An Improved Design Procedure for LCC Resonant Filter of Dimmable Electronic Ballasts for Fluorescent Lamps, Based on Lamp Model, IEEE Transactions on Power Electronics, vol. 20, No. 2, Sep. 2005.
J. A. Vilela Jr. et al., An Electronic Ballast with High Power Factor and Low Voltage Stress, IEEE Transactions on Industry Applications, vol. 41, No. 4, Jul./Aug. 2005.
S. T.S. Lee et al., Use of Saturable Inductor to Improve the Dimming Characteristics of Frequency-Controlled Dimmable Electronic Ballasts, IEEE Transactions on Power Electronics, vol. 19, No. 6, Nov. 2004.
M. K. Kazimierczuk et al., Electronic Ballast for Fluorescent Lamps, IEEETransactions on Power Electronics, vol. 8, No. 4, Oct. 1993.
S. Ben-Yaakov et al., Statics and Dynamics of Fluorescent Lamps Operating at High Frequency: Modeling and Simulation, IEEE Transactions on Industry Applications, vol. 38, No. 6, Nov.-Dec. 2002.

(56) References Cited

OTHER PUBLICATIONS

H. L. Cheng et al., A Novel Single-Stage High-Power-Factor Electronic Ballast with Symmetrical Topology, IEEE Transactions on Power Electronics, vol. 50, No. 4, Aug. 2003.
J.W.F. Dorleijn et al., Standardisation of the Static Resistances of Fluorescent Lamp Cathodes and New Data for Preheating, Industry Applications Conference, vol. 1, Oct. 13, 2002-Oct. 18, 2002.
Q. Li et al., An Analysis of the ZVS Two-Inductor Boost Converter under Variable Frequency Operation, IEEE Transactions on Power Electronics, vol. 22, No. 1, Jan. 2007.
H. Peng et al., Modeling of Quantization Effects in Digitally Controlled DC-DC Converters, IEEE Transactions on Power Electronics, vol. 22, No. 1, Jan. 2007.
G. Yao et al., Soft Switching Circuit for Interleaved Boost Converters, IEEE Transactions on Power Electronics, vol. 22, No. 1, Jan. 2007.
C. M. De Oliviera Stein et al., A ZCT Auxiliary Communication Circuit for Interleaved Boost Converters Operating in Critical Conduction Mode, IEEE Transactions on Power Electronics, vol. 17, No. 6, Nov. 2002.
W. Zhang et al., A New Duty Cycle Control Strategy for Power Factor Correction and FPGA Implementation, IEEE Transactions on Power Electronics, vol. 21, No. 6, Nov. 2006.
H. Wu et al., Single Phase Three-Level Power Factor Correction Circuit with Passive Lossless Snubber, IEEE Transactions on Power Electronics, vol. 17, No. 2, Mar. 2006.
O. Garcia et al., High Efficiency PFC Converter to Meet EN61000-3-2 and A14, Proceedings of the 2002 IEEE International Symposium on Industrial Electronics, vol. 3, 2002.
P. Lee et al., Steady-State Analysis of an Interleaved Boost Converter with Coupled Inductors, IEEE Transactions on Industrial Electronics, vol. 47, No. 4, Aug. 2000.
D.K.W. Cheng et al., A New Improved Boost Converter with Ripple Free Input Current Using Coupled Inductors, Power Electronics and Variable Speed Drives, Sep. 21-23, 1998.
B.A. Miwa et al., High Efficiency Power Factor Correction Using Interleaved Techniques, Applied Power Electronics Conference and Exposition, Seventh Annual Conference Proceedings, Feb. 23-27, 1992.
Z. Lai et al., A Family of Power-Factor-Correction Controllers, Twelfth Annual Applied Power Electronics Conference and Exposition, vol. 1, Feb. 23, 1997-Feb. 27, 1997.
L. Balogh et al., Power-Factor Correction with Interleaved Boost Converters in Continuous-Inductor-Current Mode, Eighth Annual Applied Power Electronics Conference and Exposition, 1993. APEC '93. Conference Proceedings, Mar. 7, 1993-Mar. 11, 1993.
Fairchild Semiconductor, Application Note 42030, Theory and Application of the ML4821 Average Current Mode PFC Controller, Oct. 25, 2000.
Unitrode Products From Texas Instruments, BiCMOS Power Factor Preregulator, Feb. 2006.
D. Hausman, Lutron, RTISS-TE Operation, Real-Time Illumination Stability Systems for Trailing-Edge (Reverse Phase Control) Dimmers, v. 1.0 Dec. 2004.
International Rectifier, Data Sheet No. PD60230 revC, IR1150(S)(PbF), uPFC One Cycle Control PFC IC Feb. 5, 2007.
Texas Instruments, Application Report SLUA308, UCC3817 Current Sense Transformer Evaluation, Feb. 2004.
Texas Instruments, Application Report SPRA902A, Average Current Mode Controlled Power Factor Correctiom Converter using TMS320LF2407A, Jul. 2005.
Unitrode, Design Note DN-39E, Optimizing Performance in UC3854 Power Factor Correction Applications, Nov. 1994.
Fairchild Semiconductor, Application Note 42030, Theory and Application of the ML4821 Average Currrent Mode PFC Controller, Aug. 1997.
Fairchild Semiconductor, Application Note AN4121, Design of Power Factor Correction Circuit Using FAN7527B, Rev.1.0.1, May 30, 2002.
Fairchild Semiconductor, Application Note 6004, 500W Power-Factor-Corrected (PFC) Converter Design with FAN4810, Rev. 1.0.1, Oct. 31, 2003.
Fairchild Semiconductor, FAN4822, ZVA Average Current PFC Controller, Rev. 1.0.1 Aug. 10, 2001.
Fairchild Semiconductor, ML4821, Power Factor Controller, Rev. 1.0.2, Jun. 19, 2001.
Fairchild Semiconductor, ML4812, Power Factor Controller, Rev. 1.0.4, May 31, 2001.
Linear Technology, 100 Watt LED Driver, Linear Technology, 2006.
Fairchild Semiconductor, FAN7544, Simple Ballast Controller, Rev. 1.0.0, 2004.
Fairchild Semiconductor, FAN7532, Ballast Controller, Rev. 1.0.2, Jun. 2006.
Fairchild Semiconductor, FAN7711, Ballast Control IC, Rev. 1.0.2, Mar. 2007.
Fairchild Semiconductor, KA7541, Simple Ballast Controller, Rev. 1.0.3, 2001.
ST Microelectronics, L6574, CFL/TL Ballast Driver Preheat and Dimming, Sep. 2003.
ST Microelectronics, AN993, Application Note, Electronic Ballast with PFC Using L6574 and L6561, May 2004.
International Search Report and Written Opinion for PCT/US2008/062384 dated Jan. 14, 2008.
S. Dunlap et al., Design of Delta-Sigma Modulated Switching Power Supply, Circuits & Systems, Proceedings of the 1998 IEEE International Symposium, 1998.
Freescale Semiconductor, Inc., Dimmable Light Ballast with Power Factor Correction, Design Reference Manual, DRM067, Rev. 1, Dec. 2005.
J. Zhou et al., Novel Sampling Algorithm for DSP Controlled 2 kW PFC Converter, IEEE Transactions on Power Electronics, vol. 16, No. 2, Mar. 2001.
A. Prodic, Compensator Design and Stability Assessment for Fast Voltage Loops of Power Factor Correction Rectifiers, IEEE Transactions on Power Electronics, vol. 22, No. 5, Sep. 2007.
M. Brkovic et al., "Automatic Current Shaper with Fast Output Regulation and Soft-Switching," S.15.C Power Converters, Telecommunications Energy Conference, 1993.
Dallas Semiconductor, Maxim, "Charge-Pump and Step-Up DC-DC Converter Solutions for Powering White LEDs in Series or Parallel Connections," Apr. 23, 2002.
Freescale Semiconductor, AN3052, Implementing PFC Average Current Mode Control Using the MC9S12E128, Nov. 2005.
D. Maksimovic et al., "Switching Converters with Wide DC Conversion Range," Institute of Electrical and Electronic Engineer's (IEEE) Transactions on Power Electronics, Jan. 1991.
V. Nguyen et al., "Tracking Control of Buck Converter Using Sliding-Mode with Adaptive Hysteresis," Power Electronics Specialists Conference, 1995. PESC apos; 95 Record., 26th Annual IEEE vol. 2, Issue , Jun. 18-22, 1995 pp. 1086-1093.
S. Zhou et al., "A High Efficiency, Soft Switching DC-DC Converter with Adaptive Current-Ripple Control for Portable Applications," IEEE Transactions on Circuits and Systems—II: Express Briefs, vol. 53, No. 4, Apr. 2006.
K. Leung et al., "Use of State Trajectory Prediction in Hysteresis Control for Achieving Fast Transient Response of the Buck Converter," Circuits and Systems, 2003. ISCAS apos;03. Proceedings of the 2003 International Symposium, vol. 3, Issue , May 25-28, 2003 pp. III-439-III-442 vol. 3.
K. Leung et al., "Dynamic Hysteresis Band Control of the Buck Converter with Fast Transient Response," IEEE Transactions on Circuits and Systems—II: Express Briefs, vol. 52, No. 7, Jul. 2005.
Y. Ohno, Spectral Design Considerations for White LED Color Rendering, Final Manuscript, Optical Engineering, vol. 44, 111302 (2005).
S. Skogstad et al., A Proposed Stability Characterization and Verification Method for High-Order Single-Bit Delta-Sigma Modulators, Norchip Conference, Nov. 2006 http://folk.uio.no/savskogs/pub/A_Proposed_Stability_Characterization.pdf.
J. Turchi, Four Key Steps to Design a Continuous Conduction Mode PFC Stage Using the NCP1653, ON Semiconductor, Publication Order No. AND184/D, Nov. 2004.

(56) References Cited

OTHER PUBLICATIONS

Megaman, D or S Dimming ESL, Product News, Mar. 15, 2007.
J. Qian et al., New Charge Pump Power-Factor-Correction Electronic Ballast with a Wide Range of Line Input Voltage, IEEE Transactions on Power Electronics, vol. 14, No. 1, Jan. 1999.
P. Green, A Ballast that can be Dimmed from a Domestic (Phase-Cut) Dimmer, IRPLCFL3 rev. b, International Rectifier, http://www.irf.com/technical-info/refdesigns/cf1-3.pdf, printed Mar. 24, 2007.
J. Qian et al., Charge Pump Power-Factor-Correction Technologies Part II: Ballast Applications, IEEE Transactions on Power Electronics, vol. 15, No. 1, Jan. 2000.
Chromacity Shifts in High-Power White LED Systems due to Different Dimming Methods, Solid-State Lighting, http://www.lrc.rpi.edu/programs/solidstate/completedProjects.asp?ID=76, printed May 3, 2007.
S. Chan et al., Design and Implementation of Dimmable Electronic Ballast Based on Integrated Inductor, IEEE Transactions on Power Electronics, vol. 22, No. 1, Jan. 2007.
M. Madigan et al., Integrated High-Quality Rectifier-Regulators, IEEE Transactions on Industrial Electronics, vol. 46, No. 4, Aug. 1999.
T. Wu et al., Single-Stage Electronic Ballast with Dimming Feature and Unity Power Factor, IEEE Transactions on Power Electronics, vol. 13, No. 3, May 1998.
F. Tao et al., "Single-Stage Power-Factor-Correction Electronic Ballast with a Wide Continuous Dimming Control for Fluorescent Lamps," IEEE Power Electronics Specialists Conference, vol. 2, 2001.
Azoteq, IQS17 Family, IQ Switch®—ProxSense™ Series, Touch Sensor, Load Control and User Interface, IQS17 Datasheet V2.00.doc, Jan. 2007.
C. Dilouie, Introducing the LED Driver, EC&M, Sep. 2004.
S. Lee et al., TRIAC Dimmable Ballast with Power Equalization, IEEE Transactions on Power Electronics, vol. 20, No. 6, Nov. 2005.
L. Gonthier et al., EN55015 Compliant 500W Dimmer with Low-Losses Symmetrical Switches, 2005 European Conference on Power Electronics and Applications, Sep. 2005.
Why Different Dimming Ranges? The Difference Between Measured and Perceived Light, 2000 http://www.lutron.com/ballast/pdf/LutronBallastpg3.pdf.
D. Hausman, Real-Time Illumination Stability Systems for Trailing-Edge (Reverse Phase Control) Dimmers, Technical White Paper, Lutron, version 1.0, Dec. 2004, http://www.lutron.com/technical_info/pdf/RTISS-TE.pdf.
Light Dimmer Circuits, www.epanorama.net/documents/lights/lightdimmer.html, printed Mar. 26, 2007.
Light Emitting Diode, http://en.wikipedia.org/wiki/Light-emitting_diode, printed Mar. 27, 2007.
Color Temperature, www.sizes.com/units/color_temperature.htm, printed Mar. 27, 2007.
S. Lee et al., A Novel Electrode Power Profiler for Dimmable Ballasts Using DC Link Voltage and Switching Frequency Controls, IEEE Transactions on Power Electronics, vol. 19, No. 3, May 2004.
Y. Ji et al., Compatibility Testing of Fluorescent Lamp and Ballast Systems, IEEE Transactions on Industry Applications, vol. 35, No. 6, Nov./Dec. 1999.
National Lighting Product Information Program, Specifier Reports, "Dimming Electronic Ballasts," vol. 7, No. 3, Oct. 1999.
Supertex Inc., Buck-based LED Drivers Using the HV9910B, Application Note AN-H48, Dec. 28, 2007.
D. Rand et al., Issues, Models and Solutions for Triac Modulated Phase Dimming of LED Lamps, Power Electronics Specialists Conference, 2007.
Supertex Inc., HV9931 Unity Power Factor LED Lamp Driver, Application Note AN-H52, Mar. 7, 2007.
Supertex Inc., 56W Off-line LED Driver, 120VAC with PFC, 160V, 350mA Load, Dimmer Switch Compatible, DN-H05, Feb. 2007.
ST Microelectronics, Power Factor Corrector L6561, Jun. 2004.
Fairchild Semiconductor, Application Note 42047 Power Factor Correction (PFC) Basics, Rev. 0.9.0 Aug. 19, 2004.
M. Radecker et al., Application of Single-Transistor Smart-Power IC for Fluorescent Lamp Ballast, Thirty-Fourth Annual Industry Applications Conference IEEE, vol. 1, Oct. 3, 1999-Oct. 7, 1999.
M. Rico-Secades et al., Low Cost Electronic Ballast for a 36-W Fluorescent Lamp Based on a Current-Mode-Controlled Boost Inverter for a 120-V DC Bus Power Distribution, IEEE Transactions on Power Electronics, vol. 21, No. 4, Jul. 2006.
Fairchild Semiconductor, FAN4800, Low Start-up Current PFC/PWM Controller Combos, Nov. 2006.
Fairchild Semiconductor, FAN4810, Power Factor Correction Controller, Sep. 24, 2003.
Fairchild Semiconductor, FAN4822, ZVS Average Current PFC Controller, Aug. 10, 2001.
Fairchild Semiconductor, FAN7527B, Power Factor Correction Controller, 2003.
Fairchild Semiconductor, ML4821, Power Factor Controller, Jun. 19, 2001.
Freescale Semiconductor, AN1965, Design of Indirect Power Factor Correction Using 56F800/E, Jul. 2005.
International Search Report for PCT/US2008/051072, mailed Jun. 4, 2008.
"HV9931 Unity Power Factor LED Lamp Driver, Initial Release", Supertex Inc., Sunnyvale, CA USA 2005.
AN-H52 Application Note: "HV9931 Unity Power Factor LED Lamp Driver" Mar. 7, 2007, Supertex Inc., Sunnyvale, CA, USA.
Dustin Rand et al: "Issues, Models and Solutions for Triac Modulated Phase Dimming of LED Lamps" Power Electronics Specialists Conferrence, 2007. PESC 2007. IEEE, IEEE, P1, Jun. 1, 2007, pp. 1398-1404.
Spiazzi G et al: "Analysis of a High-Power Factor Electronic Ballast for High Brightness Light Emitting Diodes" Power Electronics Specialists, 2005 IEEE 36th Conference on Jun. 12, 2005, Piscatawa, NJ, USA, IEEE, Jun. 12, 2005, pp. 1494-1499.
International Search Report PCT/US2008/062381 dated Feb. 5, 2008.
International Search Report PCT/US2008/056739 dated Dec. 3, 2008.
Written Opinion of the International Searching Authority PCT/US2008/062381 dated Feb. 5, 2008.
Ben-Yaakov et al, "The Dynamics of a PWM Boost Converter with Resistive Input" IEEE Transactions on Industrial Electronics, IEEE Service Center, Piscataway, NJ, USA, vol. 46, No. 3, Jun. 1, 1999.
International Search Report PCT/US2008/062398 dated Feb. 5, 2008.
Partial International Search Report PCT/US2008/062387 dated Feb. 5, 2008.
Noon, Jim "UC3855A/B High Performance Power Factor Preregulator", Texas Instruments, SLUA146A, May 1996, Revised Apr. 2004.
International Search Report PCT/GB2006/003259 dated Jan. 12, 2007.
Written Opinion of the International Searching Authority PCT/US2008/056739 dated Dec. 3, 2008.
International Search Report PCT/US2008/056606 dated Dec. 3, 2008.
Written Opinion of the International Searching Authority PCT/US2008/056606 dated Dec. 3, 2008.
International Search Report PCT/US2008/056608 dated Dec. 3, 2008.
Written Opinion of the International Searching Authority PCT/US2008/056608 dated Dec. 3, 2008.
International Search Report PCT/GB2005/050228 dated Mar. 14, 2006.
International Search Report PCT/US2008/062387 dated Jan. 10, 2008.
Data Sheet LT3496 Triple Output LED Driver, Linear Technology Corporation, Milpitas, CA 2007.
Linear Technology, News Release,Triple Output LED, LT3496, Linear Technology, Milpitas, CA, May 24, 2007.
Power Integrations, Inc., "TOP200-4/14 TOPSwitch Family Three-terminal Off-line PWM Switch", XP-002524650, Jul. 1996, Sunnyvale, California.
Texas Instruments, SLOS318F, "High-Speed, Low Noise, Fully-Differential I/O Amplifiers," THS4130 and THS4131, US, Jan. 2006.

(56) References Cited

OTHER PUBLICATIONS

International Search Report and Written Opinion, PCT US20080062387, dated Feb. 5, 2008.
International Search Report and Written Opinion, PCT US200900032358, dated Jan. 29, 2009.
Hirota, Atsushi et al, "Analysis of Single Switch Delta-Sigma Modulated Pulse Space Modulation PFC Converter Effectively Using Switching Power Device," IEEE, US, 2002.
Prodic, Aleksandar, "Digital Controller for High-Frequency Rectifiers with Power Factor Correction Suitable for On-Chip Implementation," IEEE, US, 2007.
International Search Report and Written Opinion, PCT US20080062378, dated Feb. 5, 2008.
International Search Report and Written Opinion, PCT US20090032351, dated Jan. 29, 2009.
Erickson, Robert W. et al, "Fundamentals of Power Electronics," Second Edition, Chapter 6, Boulder, CO, 2001.
Allegro Microsystems, A1442, "Low Voltage Full Bridge Brushless DC Motor Driver with Hall Commutation and Soft-Switching, and Reverse Battery, Short Circuit, and Thermal Shutdown Protection," Worcester MA, 2009.
Texas Instruments, SLUS828B, "8-Pin Continuous Conduction Mode (CCM) PFC Controller", UCC28019A, US, revised Apr. 2009.
Analog Devices, "120 kHz Bandwidth, Low Distortion, Isolation Amplifier", AD215, Norwood, MA, 1996.
Burr-Brown, ISO120 and ISO121, "Precision Los Cost Isolation Amplifier," Tucson AZ, Mar. 1992.
Burr-Brown, ISO130, "High IMR, Low Cost Isolation Amplifier," SBOS220, US, Oct. 2001.
International Search Report and Written Report PCT US20080062428 dated Feb. 5, 2008.
Prodic, A. et al, "Dead Zone Digital Controller for Improved Dynamic Response of Power Factor Preregulators," IEEE, 2003.
Mamano, Bob, "Current Sensing Solutions for Power Supply Designers", Unitrode Seminar Notes SEM1200, 1999.
http://toolbarpdf.com/docs/functions-and-features-of-inverters.html printed on Jan. 20, 2011.
Linear Technology, "Single Switch PWM Controller with Auxiliary Boost Converter," LT1950 Datasheet, Linear Technology, Inc. Milpitas, CA, 2003.
Yu, Zhenyu, 3.3V DSP for Digital Motor Control, Texas Instruments, Application Report SPRA550 dated Jun. 1999.
International Rectifier, Data Sheet No. PD60143-O, Current Sensing Single Channel Driver, El Segundo, CA, dated Sep. 8, 2004.
Balogh, Laszlo, "Design and Application Guide for High Speed MOSFET Gate Drive Circuits" [Online] 2001, Texas Instruments, Inc., SEM-1400, Unitrode Power Supply Design Seminar, Topic II, TI literature No. SLUP133, XP002552367, Retrieved from the Internet: URL:htt/://focus.ti.com/lit/ml/slup169/slup169.pdf the whole document.
ST Datasheet L6562, Transition-Mode PFC Controller, 2005, STMicroelectronics, Geneva, Switzerland.
Maksimovic, Regan Zane and Robert Erickson, Impact of Digital Control in Power Electronics, Proceedings of 2004 International Symposium on Power Semiconductor Devices & Ics, Kitakyushu, , Apr. 5, 2010, Colorado Power Electronics Center, ECE Department, University of Colorado, Boulder, CO.
Texas Instruments, Interleaving Continuous Conduction Mode PFC Controller, UCC28070, SLUS794C, Nov. 2007, revised Jun. 2009, Texas Instruments, Dallas TX.
Lutron, Flourescent Dimming Systems Technical Guide, copyright 2002, Why Different Dimming Ranges?, p. 3, Lutron Electronics Co., Inc., Coopersburg, PA, USA.
Amanci, et al, "Synchronization System with Zero-Crossing Peak Detection Algorithm for Power System Applications", The 2010 International Power Electronics Conference, pp. 2984-2991, Toronto, Ontario, Canada.
Patterson, James, "Efficient Method for Interfacing Triac Dimmers and LEDs", National Semiconductor Corp., pp. 29-32, Jun. 23, 2011, USA.
Vainio, Olli, "Digital Filtering for Robust 50/60 Hz Zero-Crossing Detectors", IEEE Transactions on Instrumentation and Measurement, vol. 45, No. 2, pp. 426-430, Apr. 1996, University of Santa Barbara, California, USA.
Supertex, Inc., HV9931 Unity Power Factor LED Lamp Driver, pp. 1-7, 2005, Sunnyvale, CA, USA (Per MPEP 609.04(a), Applicant points out that the year of publication is sufficiently earlier than the effective U.S. filing date and any foreign priority date so that the particular month of publication is not in issue.).
Wang Xiao, Phase Control Dimming of the Dimmable Lighting System, Journal of Wuxi University of Light Industry, Jul. 31, 2000, vol. 19, No. 4, pp. 1-3. The Abstract contains a concise explanation in English, and the Search Report identifies the following portions as related to the claims in the Present Application: p. 408, right-hand column, section 2, and figures 5-7.
Search Report, Chinese Application No. 201010299511X, The State Intellectual Property Office of the People's Republic of China, Aug. 5, 2014, pp. 1-2.
Search Report, Chinese Application No. 201010299511X, The State Intellectual Property Office of the People's Republic of China, Jan. 26, 2015, pp. 1-2.
Third Office Action dated Feb. 3, 2015, mailed in Application No. 201010299511X, The State Intellectual Property Office of the People's Republic of China, pp. 1-6.
Second Office Action dated Aug. 13, 2014, mailed in Application No. 201010299511X, The State Intellectual Property Office of the People's Republic of China, pp. 1-6.
First Office Action dated Jan. 6, 2014, mailed in Application No. 201010299511X, The State Intellectual Property Office of the People's Republic of China, pp. 1-4.
First Office Action dated Sep. 4, 2013, mailed in Application No. 099133433, The Intellectual Property Office of Taiwan, pp. 1-5.
Search Report dated Aug. 19, 2013, mailed in Application No. 099133433, The Intellectual Property Office of Taiwan, 1 page.
Second Office Action dated Apr. 8, 2014, mailed in Application No. 099133433, The Intellectual Property Office of Taiwan, pp. 1-5.
Search Report dated Apr. 3, 2014, mailed in Application No. 099133433, The Intellectual Property Office of Taiwan, pp. 1-5.
Third Office Action dated Feb. 3, 2015, mailed in Application No. 099133433, The Intellectual Property Office of Taiwan, pp. 1-2.

* cited by examiner

PHASE CONTROL DIMMING COMPATIBLE LIGHTING SYSTEMS

CROSS REFERENCE TO RELATED APPLICATIONS

U.S. patent application Ser. No. 11/967,269, entitled "Power Control System Using a Nonlinear Delta-Sigma Modulator with Nonlinear Power Conversion Process Modeling," inventor John L. Melanson, and filed on Dec. 31, 2007 describes exemplary methods and systems and is incorporated by reference in its entirety. Referred to herein as Melanson I.

U.S. patent application Ser. No. 11/967,271, entitled "Power Factor Correction Controller with Feedback Reduction," inventor John L. Melanson, and filed on Dec. 31, 2007 describes exemplary methods and systems and is incorporated by reference in its entirety. Referred to herein as Melanson II.

U.S. patent application Ser. No. 11/967,273, entitled "System and Method with Inductor Flyback Detection Using Switch Date Charge Characteristic Detection," inventor John L. Melanson, and filed on Dec. 31, 2007 describes exemplary methods and systems and is incorporated by reference in its entirety. Referred to herein as Melanson III.

U.S. patent application Ser. No. 11/967,275, entitled "Programmable Power Control System," inventor John L. Melanson, and filed on Dec. 31, 2007 describes exemplary methods and systems and is incorporated by reference in its entirety. Referred to herein as Melanson IV.

U.S. patent application Ser. No. 11/967,272, entitled "Power Factor Correction Controller With Switch Node Feedback", inventor John L. Melanson, and filed on Dec. 31, 2007 describes exemplary methods and systems and is incorporated by reference in its entirety. Referred to herein as Melanson V.

U.S. patent application Ser. No. 12/347,138, entitled "Switching Power Converter Control With Triac-Based Leading Edge Dimmer Compatibility", inventors Michael A. Cost, Mauro L. Gaetano, and John L. Melanson, and filed on Dec. 31, 2008 describes exemplary methods and systems and is incorporated by reference in its entirety. Referred to herein as Melanson VI.

BACKGROUND OF THE INVENTION

1. Field of the Invention

The present invention relates in general to the field of electronics, and more specifically to a system and method for providing compatibility between phase controlled dimmers and lighting systems.

2. Description of the Related Art

Dimming a light source saves energy and also allows a user to adjust the intensity of the light source to a desired level. Many facilities, such as homes and buildings, include light source dimming circuits (referred to herein as "dimmers"). Power control systems with switching power converters are used to control light sources, such as discharge-type lamps. Discharge lamps include gas discharge lamps such as, fluorescent lamps, and high intensity discharge lamps, such as mercury vapor lamps, metal halide (MH) lamps, ceramic MH lamps, sodium vapor lamps, and Xenon short-arc lamps. However, conventional phase control dimmers, such as a triac-based dimmer, that are designed for use with resistive loads, such as incandescent light bulbs, often do not perform well when supplying a raw, phase modulated signal to a reactive load, such as a switching power converter. Ballasts for many discharge lamps are not compatible with phase control dimmers. Many discharge lighting systems receive dimming information from a dimmer that provides a dedicated dimming signal. The dedicated dimming signal provides dimming information that is separate from power signals.

FIG. 1 depicts a power/lighting system 100 that receives dimming information via a dedicated dimming signal and, thus, avoids the problems of receiving dimming information via a phase-control dimmer Dimmer 102 provides lamp ballast 104 with a dedicated dimming signal in the form of dimming voltage signal $D_V$. Dimmer 102 provides a reliable dimming signal $D_V$. Dimmer 102 passes the AC input voltage $V_{IN}$ from AC voltage source 106 to lamp ballast 104. Input voltage $V_{IN}$ is, for example, a 60 Hz/110 V line voltage in the United States of America or a 50 Hz/220 V line voltage in Europe. Lamp ballast 104 provides a lamp voltage $V_{LAMP}$ to drive discharge lamp 108. The value of the lamp voltage $V_{LAMP}$ depends on the value of dimming voltage signal $D_V$.

FIG. 2 depicts a light output graph 400 representing a graphical dimming-intensity function 202 between values of the dimming voltage $D_V$ and the percentage light intensity level of discharge lamp 108. The dimming voltage $D_V$ ranges from 0-10V, and the light intensity level percentage of discharge lamp 108 ranges from 10-100%. The dimming-intensity function 202 indicates that lamp ballast 104 saturates when the dimming voltage $D_V$ equals 1V and 9V. Between dimming voltage $D_V$ values of 0-1V, lamp ballast 104 drives the discharge lamp 106 to 10% intensity. Between dimming voltage $D_V$ values of 9-10V, lamp ballast 104 drives the discharge lamp 106 to 100% intensity, i.e. full "ON". The dimming-intensity function 202 is linear between dimming voltage $D_V$ values of 1-9V with intensity of lamp 106 varying from 10-100%.

Phase control dimmers are ubiquitous but do not work well with reactive loads, such as lamp ballast 104. Thus, lamp ballast 104 does not interface with existing phase control dimmer installations. Thus, for lighting systems having an existing phase control dimmer, the phase control dimmer is replaced or bypassed to facilitate use of dimmer 102. Replacing or bypassing phase controlled dimmer adds additional cost to the installation of dimmer 102. Additionally, lamp ballast 104 does not provide a full-range of dimming for lamp 106.

SUMMARY OF THE INVENTION

In one embodiment of the present invention, an apparatus includes a controller having an input to receive a phase control dimming signal. The controller is configured to: (i) convert the phase control dimming signal into dimming information and (ii) generate a power factor correction (PFC) control signal for a switching power converter. The controller further includes a first output to provide the dimming information and a second output to provide the PFC control signal.

In another embodiment of the present invention, a method includes receiving a phase control dimming signal and converting the phase control dimming signal into dimming information for a lighting system. The method also includes generating a power factor correction (PFC) control signal for a switching power converter.

In a further embodiment of the present invention, a power control/lighting system includes a switching power converter having at least one input to receive a phase control dimming signal. The power control/lighting system also includes a controller having an input to receive the phase control dimming signal. The controller is configured to: (i) convert the phase control dimming signal into dimming information and (ii) generate a power factor correction (PFC) control signal for a switching power converter. The controller further includes a first output to provide the dimming information and a second output coupled to the switching power converter to provide the PFC control signal. The power control/lighting system also includes a lamp ballast coupled to the switching power converter and the second output of the controller and further includes a discharge-type lamp coupled to the lamp ballast.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A power control/lighting system includes a controller to provide compatibility between a lamp ballast configured to receive a dedicated dimmer signal and a phase control dimmer. In at least one embodiment, the controller converts a phase control dimming signal into dimming information useable by a lamp ballast of a gas discharge lamp based lighting system. Additionally, in at least one embodiment, the controller also controls power factor correction of the power control/lighting system. In at least one embodiment, the controller provides dimming information based on the phase control dimming signal that allows the lamp ballast to be used in conjunction with a phase control dimmer. In at least one embodiment, the controller also enables a switching power converter to provide a sufficiently high resistive load during phase delays of the phase control dimmer to, for example, prevent ripple and missed chopping of a phase dimmer output signal. In at least one embodiment, the controller can be configured to convert the phase control dimming signal into any format, protocol, or signal type so that the dimming information is compatible with input specifications of lamp ballast.

Light intensity level refers to the brightness of light from a lamp. In at least one embodiment, the light intensity level is represented as a percentage of a lamps' full brightness with 100% representing full brightness. In at least one embodiment, the controller is not limited to a linear light intensity level conversion between a light intensity level represented by a conduction angle of the phase control dimming signal and the light intensity level represented by the resultant dimming information. In at least one embodiment, to facilitate non-linear mapping, the controller maps light intensity levels represented by the phase control dimming signal to dimming information using a mapping function. Utilizing a mapping function that is not limited to a linear light intensity level conversion of the light intensity level represented by the phase control dimming signal to the dimming information provides flexibility to provide custom control of the light intensity level of a lamp.

Figure 1:
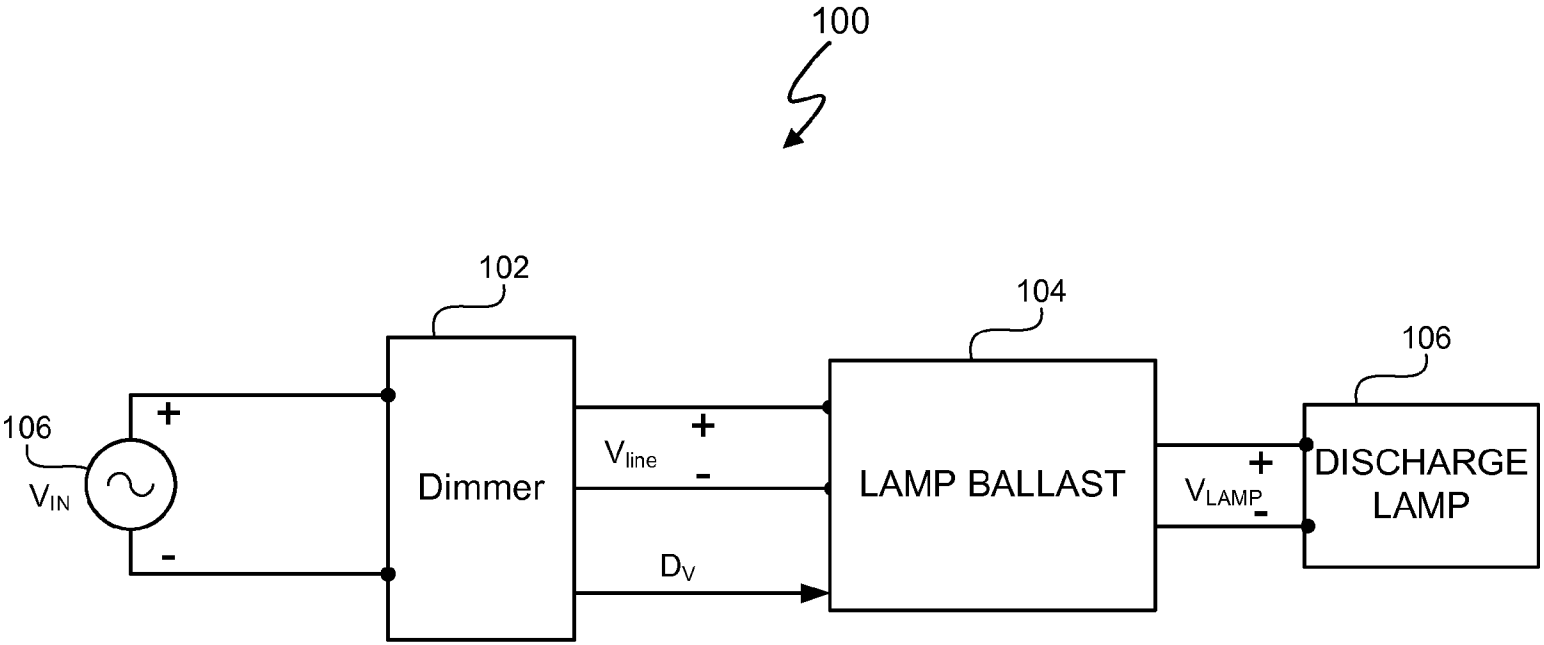
FIG. 1 (prior art)
FIG. 1 (labeled prior art) depicts a power/lighting system that receives dimming information via a dedicated dimming signal.
Figure 2:
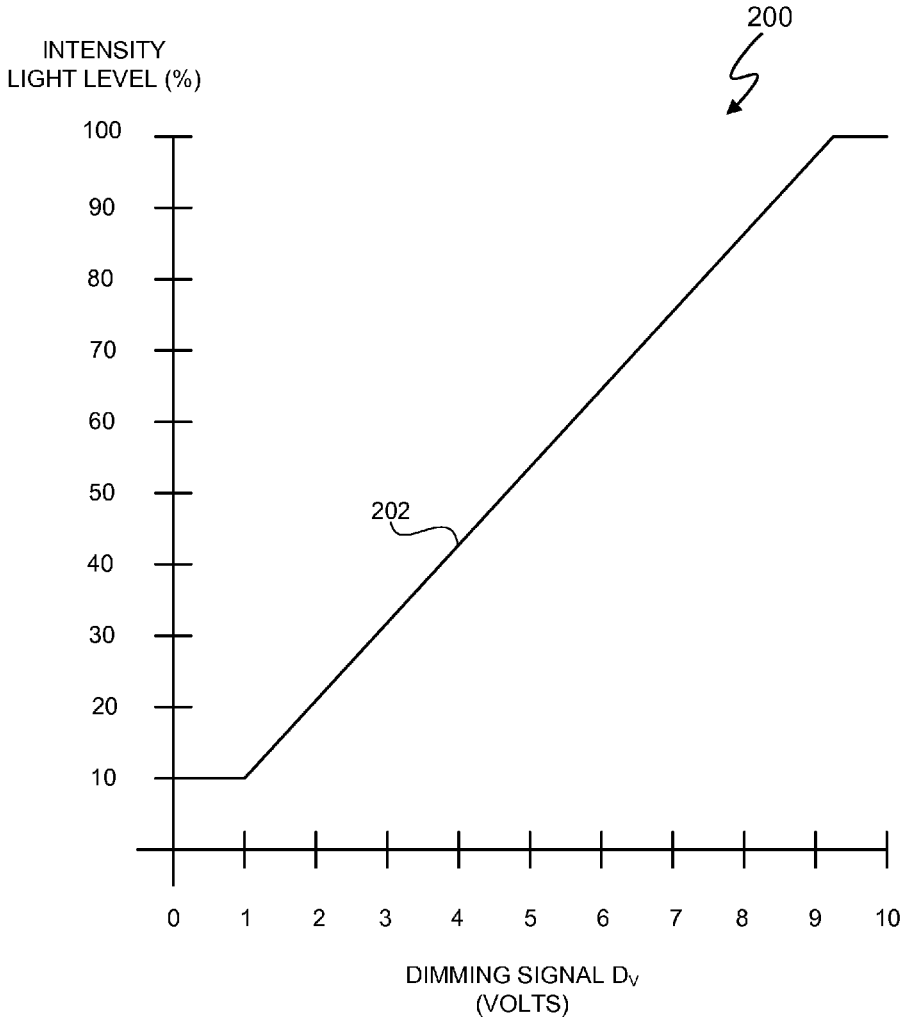
FIG. 2 (prior art)
FIG. 2 depicts a light output graph representing a linear function between dimming voltage values and percentage light intensity levels in the power control/lighting system of FIG. 1.
Figure 3:
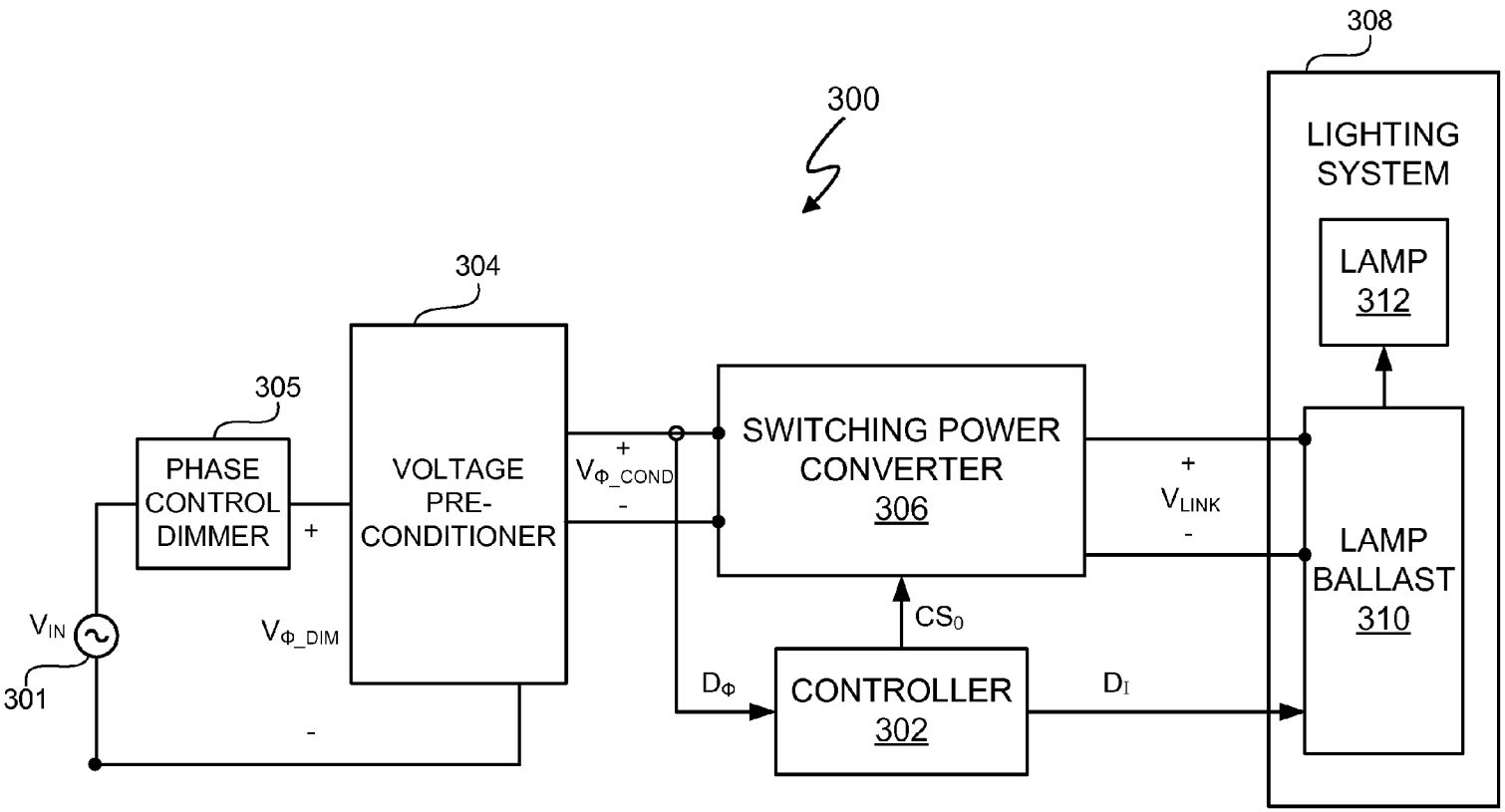
FIG. 3 depicts a power control/lighting system that includes a controller to convert a phase control dimming signal into dimming information.

FIG. 3 depicts an exemplary power control/lighting system 300 that includes a controller 302 to convert a phase control dimming signal $V_{\Phi_DIM}$ into dimming information $D_I$. Lamp ballast 310 is configured to receive a dimmer signal with dimmer information $D_I$, and controller 302 provides compatibility between phase control dimmer 305 and lamp ballast 310. Thus, among other functions, in at least one embodiment, controller 302 provides an interface between phase control dimmer 305 and lighting system 308 so that lighting system 308 can be dimmed using dimming information derived from phase control dimmer 305. The particular type of phase control dimmer 305 is a matter of design choice. In at least one embodiment, phase control dimmer 305 is a bidirectional triode thyristor (triac)-based circuit. Melanson VI describes an exemplary triac-based phase control dimmer. In at least one embodiment, phase control dimmer 305 is a transistor based dimmer, such as an insulated gate bipolar transistor (IGBT) based phase control dimmer, such as IGBT based phase control dimmers available from Strand Lighting, Inc., of Cypress, Calif., USA.

As explained in more detail with reference to FIG. 4, phase control dimmer 305 introduces phase delays with corresponding conduction angles in the input voltage $V_{IN}$ from AC voltage source 301. Input voltage $V_{IN}$ is, for example, a 60 Hz/110 V line voltage in the United States of America or a 50 Hz/220 V line voltage in Europe. Voltage preconditioner 304 receives the resultant phase control voltage $V_{\Phi_DIM}$ from phase control dimmer 305 and generates a conditioned phase control voltage $V_{\Phi_COND}$ for input to switching power converter 306. In at least one embodiment, voltage pre-conditioner 304 includes a rectifier, such as diode rectifier 503 (FIG. 5) and an EMI filter, such as capacitor 515. Thus, in at least one embodiment, phase control voltage $V_{\Phi_COND}$ is a rectified sine wave with attenuated high frequency components. Switching power converter 306 converts the phase control voltage $V_{\Phi_COND}$ into an approximately constant link voltage $V_{LINK}$.

Figure 4:
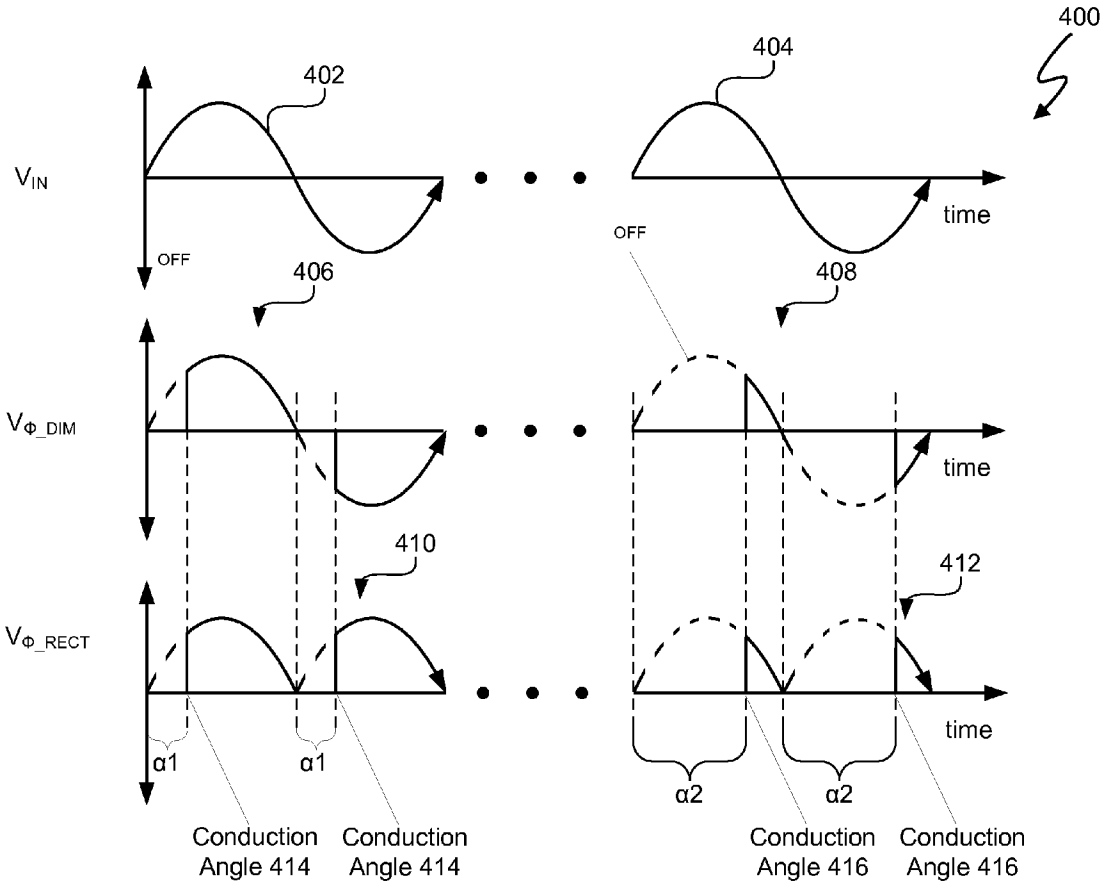
FIG. 4 (labeled prior art) depicts exemplary voltage signals of the power control/lighting system of FIG. 3.

FIG. 4 depicts a series of voltage waveforms 400 that represent two respective exemplary cycles of waveforms of input voltage $V_{IN}$, phase control voltage $V_{\Phi_DIM}$, and rectified phase control input voltage $V_{\Phi_RECT}$. Referring to FIGS. 3 and 4, during a dimming period, phase control dimmer 305 phase modulates the supply voltage $V_{IN}$ by introducing phase delays a into the beginning of each half cycle of phase control voltage $V_{\Phi_DIM}$. "$\alpha$" represents an elapsed time between the beginning and leading edge of each half cycle of phase control voltage $V_{\Phi_DIM}$. ("Introducing phase delays" is also referred to as "chopping"). The portion of the phase control voltage $V_{\Phi_DIM}$ having a phase delay $\alpha$ is referred to as the "dimming portion". For example, the phase delayed portions of voltages $V_{\Phi_DIM}$ and $V_{\Phi_RECT}$ represented by $\alpha 1$ and $\alpha 2$ are referred to as the "dimming portion" of voltages $V_{\Phi_DIM}$ and $V_{\Phi_RECT}$. A "conduction angle" of the phase control voltage $V_{\Phi_DIM}$ is the angle at which the phase delay a ends. The particular conduction angle of phase control voltage $V_{\Phi_DIM}$ can be set by manually or automatically operating phase control dimmer 305.

The phase delay $\alpha$ and conduction angle are inversely related, i.e. as the phase delay $\alpha$ increases, the conduction angle decreases, and vice versa. When the phase delay $\alpha$ is zero, the conduction angle is 180 degrees for a half cycle of phase control voltage $V_{\Phi_DIM}$, and phase control dimmer 305 simply passes the supply voltage $V_{IN}$ to full bridge diode rectifier 503. A conduction angle of 180 degrees for a half cycle of phase control voltage $V_{\Phi_DIM}$ is the equivalent of a conduction angle of 360 degrees for a full cycle of phase control voltage $V_{\Phi_DIM}$. As subsequently described in more detail, the amount of phase delay $\alpha$ and the corresponding conduction angle depend upon the amount of selected dimming.

In at least one embodiment, supply voltage $V_{IN}$ is a sine wave, as depicted, with two exemplary cycles 402 and 404. Phase control dimmer 305 generates the phase modulated voltage $V_{\Phi_DIM}$ by chopping each half cycle of supply voltage $V_{IN}$ to generate one, leading edge phase delay $\alpha 1$ for each respective half cycle of cycles 406 and 408 ($V_{\Phi_DIM}$) and 410 and 412 ($V_{\Phi_RECT}$). As the phase delay $\alpha$ increases, less power is delivered to lamp 312. Thus, changes in the phase angle $\alpha$ are inversely proportional to both the conduction angle and the intensity of lamp 312. For example, when the phase delay $\alpha$ increases, the light intensity level increases and the conduction angle of lamp 312 decreases. Phase delay al is shorter than phase delay $\alpha 2$ (and, thus, conduction angle 414 is greater than conduction angle 416), so cycle 408 represents a decrease in light intensity level relative to cycle 406.

Referring to FIG. 3, controller 302 includes an input to receive phase control signal $D_\Phi$. Phase control signal $D_\Phi$ represents the phase control voltage $V_{\Phi_COND}$. In at least one embodiment, phase control signal $D_\Phi$ is the phase control voltage $V_{\Phi_COND}$. In at least one embodiment, phase control signal $D_\Phi$ is a scaled version of phase control voltage $V_{\Phi_COND}$. Phase control signal $D_\Phi$ has a conduction angle representing a light intensity level. Controller 302 converts phase control signal $D_\Phi$ into dimming information $D_I$. In at least one embodiment, dimming information $D_I$ is a dedicated signal that specifies the light intensity level for lamp 312.

Lighting system 308 includes a lamp ballast 310, and lamp ballast 310 receives a link voltage $V_{LINK}$ and dimming information $D_I$. The link voltage $V_{LINK}$ is a power factor corrected, regulated voltage supplied by switching power converter 306. In at least one embodiment, lamp 312 is a discharge lamp such as a fluorescent lamp or a high intensity discharge lamp. Lamp ballast 310 can be any type of lamp ballast that controls the light intensity of lamp 312 in accordance with a light intensity level indicated by dimming information $D_I$. In at least one embodiment, lamp ballast 310 is a lamp ballast PN:B254PUNV-D available from Universal Lighting Technologies having an office in Nashville, Tenn., USA. In at least one embodiment, lamp ballast 310 includes an integrated circuit (IC) processor to decode dimming information $D_I$ and control power provided to lamp 312 so that lamp 312 illuminates to a light intensity level indicated by dimming information $D_I$.

Controller 302 converts the phase control dimming signal $D_\Phi$ into any format, protocol, or signal type so that the dimming information $D_I$ is compatible with input specifications of lamp ballast 310. Thus, the dimming information can be an analog or digital signal and conform to any signal-type, format, or protocol such as a pulse width modulated signal, a linear voltage signal, a nonlinear voltage signal, a digital addressable lighting interface (DALI) protocol signal, and an inter-integrated circuit ($I^2C$) protocol signal. For example, in one embodiment, controller 302 converts the phase control dimming signal $D_\Phi$ into dimming information $D_I$ represented by a voltage signal ranging from 0-10V In one embodiment, controller 302 generates the dimming information $D_I$ as a pulse width modulated signal representing values 0-126, thus providing 127 light intensity levels.

As subsequently described in more detail, in at least one embodiment, controller 302 is not limited to linearly converting a light intensity level represented by a conduction angle of the phase control dimming signal $D_\Phi$ and the light intensity level represented by the generated dimming information $D_I$. Thus, in at least one embodiment, controller 302 is not constrained to a one-to-one intensity level correlation between phase control dimming signal $D_\Phi$ and dimming information $D_I$. For example, in one embodiment of a non-linear conversion, a 180° degree conduction angle represents 100% intensity, and a 90° conduction angle represents an approximately 70% light intensity level. In at least one embodiment, controller 302 maps light intensity levels represented by the phase control dimming signal $D_\Phi$ to dimming information $D_I$ using a non-linear mapping function. An exemplary non-linear mapping function is described in more detail with reference to FIGS. 8 and 9. A non-linear conversion of the light intensity level represented by the phase control dimming signal $D_\Phi$ to the dimming information $D_I$ provides flexibility to provide custom control of the light intensity level of lamp 512. For example, in at least one embodiment and as subsequently described in more detail, controller 302 utilizes a mapping function to nonlinearly convert the phase control dimming signal $D_\Phi$ into dimming information $D_I$ based on human perceived light intensity levels rather than light intensity levels based on power levels. Additionally, different mapping functions can be preprogrammed for selection that depends upon, for example, the particular operating environment and/or location of lamp 312.

In at least one embodiment, controller 302 also generates a switch control signal $CS_0$ to control power factor correction for switching power converter 306 and regulate link voltage $V_{LINK}$. Switching power converter 306 can be any type of switching power converter such as a boost, buck, boost-buck converter, or a Cúk converter. In at least one embodiment, switching power converter 306 is identical to switching power converter 102. Control of power factor correction and the link voltage $V_{LINK}$ of switching power converter 306 is, for example, described in the exemplary embodiments of Melanson I, II, III, IV, and V.

Figure 5:
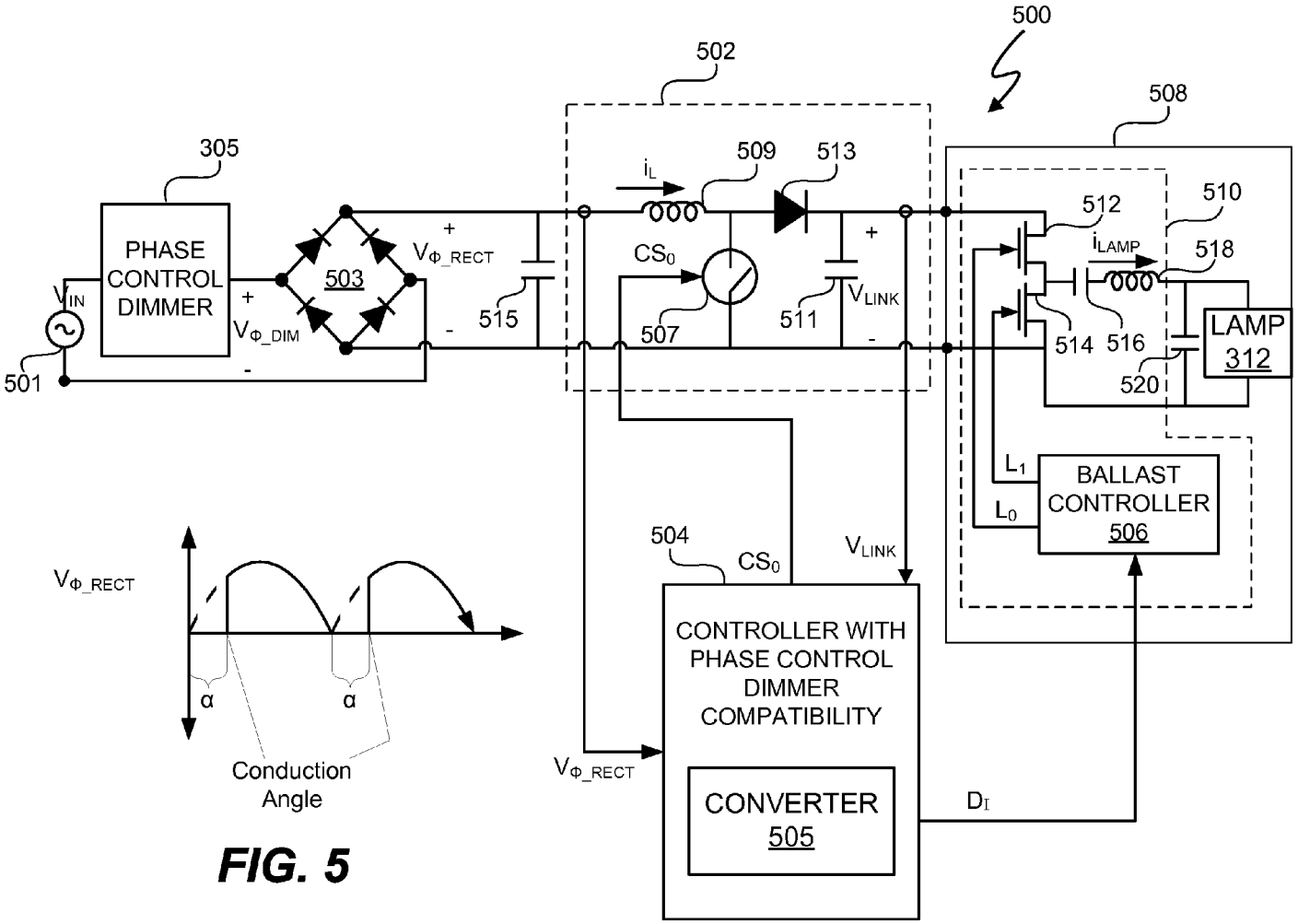
FIG. 5 depicts an embodiment of the power control/lighting system of FIG. 3.

FIG. 5 depicts power control/lighting system 500, which is one embodiment of power control/lighting system 300. As subsequently described in more detail, controller 504 represents one embodiment of controller 302. Controller 504 includes a converter 505 that converts rectified phase control input voltage $V_{\Phi_RECT}$ into dimming information $D_I$ to provide compatibility between phase control dimmer 305 and lamp ballast 310. Controller 504 also controls power factor correction for switching power converter 502. Switching power converter 502 represents one embodiment of switching power converter 306 and is a boost-type switching power converter. Voltage supply 501 provides an input voltage $V_{IN}$ as an input voltage for power control/lighting system 500. Input voltage $V_{IN}$ is, for example, a 60 Hz/110 V line voltage in the United States of America or a 50 Hz/220 V line voltage in Europe. Phase control dimmer 305 receives the supply voltage $V_{IN}$ and generates a phase control voltage $V_{\Phi_DIM}$ such as the phase control voltage $V_{\Phi_DIM}$ of FIG. 4. Full bridge, diode rectifier 503 rectifies phase control voltage $V_{\Phi_DIM}$ to generate the rectified phase control input voltage $V_{\Phi_RECT}$ to the switching power converter 502. Filter capacitor 515 provides, for example, high frequency filtering of the rectified input voltage $V_{\Phi_RECT}$. Switching power converter 502 converts the input voltage $V_{\Phi_RECT}$ into a regulated output voltage $V_{LINK}$, which provides an approximately constant supply voltage to lighting system 504. Lighting system 504 represents one embodiment of lighting system 308.

Switching power converter 502 varies an average current $i_L$ in accordance with the conduction angle of rectified phase control input voltage $V_{\Phi_RECT}$ so that the average power supplied by switching power converter 502 tracks the conduction angle of rectified phase control input voltage $V_{\Phi_RECT}$. Controller 504 controls switching power converter 502 by providing power factor correction and regulating output voltage $V_{LINK}$. The controller 504 controls an ON (i.e. conductive) and OFF (i.e. nonconductive) state of switch 507 by varying a state of pulse width modulated control signal $CS_0$. In at least one embodiment, the values of the pulse width and duty cycle of control signal $CS_o$ depend on sensing two signals, namely, the rectified phase control input voltage $V_{\Phi_RECT}$ and the capacitor voltage/output voltage $V_{LINK}$.

Switching between states of switch 507 regulates the transfer of energy from the rectified line input voltage $V_{\Phi_RECT}$ through inductor 509 to capacitor 511. The inductor current $i_L$ ramps 'up' when the switch 507 is ON. The inductor current $i_L$ ramps down when switch 507 is OFF and supplies current $i_L$ to recharge capacitor 511. The time period during which inductor current $i_L$ ramps down is commonly referred to as the "inductor flyback time". During the inductor flyback time, diode 513 is forward biased. Diode 513 prevents reverse current flow into inductor 509 when switch 507 is OFF. In at least one embodiment, the switching power converter 502 operates in discontinuous current mode, i.e. the inductor current $i_L$ ramp up time plus the inductor flyback time is less than the period of the control signal $CS_0$. When operating in continuous conduction mode, the inductor current $i_L$ ramp-up time plus the inductor flyback time equals the period of control signal $CS_0$.

The switch 507 is a field effect transistor (FET), such as an n-channel FET. Control signal $CS_0$ is a gate voltage of switch 507, and switch 507 conducts when the pulse width of $CS_0$ is high. Thus, the 'ON time' of switch 507 is determined by the pulse width of control signal $CS_0$.

Capacitor 511 supplies stored energy to lighting system 508. The capacitor 511 is sufficiently large so as to maintain a substantially constant output voltage $V_{LINK}$, as established by controller 504. As load conditions change, the output voltage $V_{LINK}$ changes. The controller 504 responds to the changes in output voltage $V_{LINK}$ and adjusts the control signal $CS_0$ to restore a substantially constant output voltage $V_{LINK}$ as quickly as possible. Power control/lighting system 100 includes a small, filter capacitor 515 in parallel with switching power converter 502. Capacitor 515 reduces electromagnetic interference (EMI) by filtering high frequency signals from the input voltage $V_{\Phi_RECT}$.

The goal of power factor correction technology is to make the switching power converter 502 appear resistive to the voltage source 501. Thus, controller 504 attempts to control the inductor current $i_L$ so that the average inductor current $i_L$ is linearly and directly related to the line input voltage $V_{\Phi_RECT}$. Control of power factor correction and the link voltage $V_{LINK}$ of switching power converter 502 is, for example, described in the exemplary embodiments of Melanson I, II, III, IV, and V.

Figure 6:
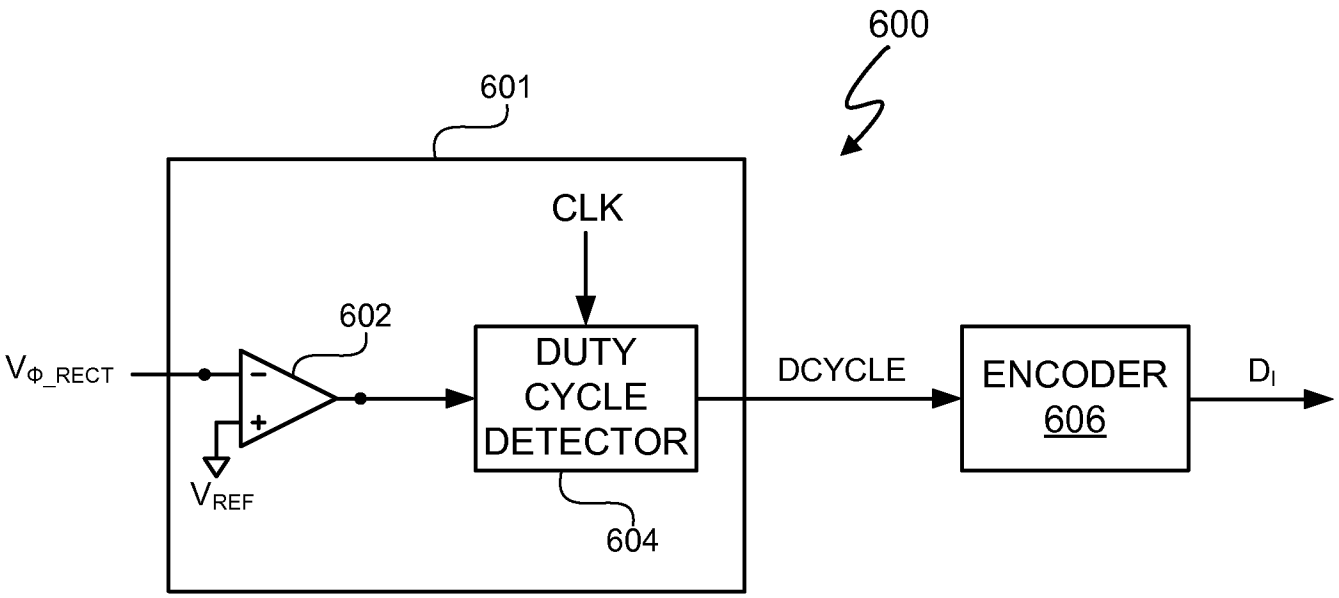
FIG. 6 depicts one embodiment of a converter that converts a phase modulated, rectified phase control input voltage into dimming information.

Converter 505 converts the rectified input voltage $V_{\Phi_RECT}$ into dimming information $D_I$. The manner of converting rectified phase control input voltage $V_{\Phi_RECT}$ into dimming information $D_I$ is a matter of design choice. FIG. 6 depicts one embodiment of a converter 600 that converts rectified phase control input voltage $V_{\Phi_RECT}$ into dimming information $D_I$. FIG. 6 depicts a converter 600 that converts rectified phase control input voltage $V_{\Phi_RECT}$ into dimmer information $D_I$. Converter 600 represents one embodiment of converter 505. Converter 600 determines the duty cycle of dimmer output signal $V_{DIM}$ by counting the number of cycles of clock signal $f_{clk}$ that occur until the chopping point of dimmer output signal $V_{DIM}$ is detected by the duty cycle time converter 600. The "chopping point" refers to the end of phase delay $\alpha$ (FIG. 5) of rectified phase control input voltage $V_{\Phi_RECT}$. The digital data DCYCLE represents the duty cycles of rectified phase control input voltage $V_{\Phi_RECT}$.

Converter 600 includes a phase detector 601 that detects a phase delay of rectified phase control input voltage $V_{\Phi_RECT}$. Comparator 602 compares rectified phase control input voltage $V_{\Phi_RECT}$ against a known reference voltage $V_{REF}$. The reference voltage $V_{REF}$ is generally the cycle cross-over point voltage of dimmer output voltage $V_{DIM}$, such as a neutral potential of a household AC voltage. The duty cycle detector 604 counts the number of cycles of clock signal CLK that occur until the comparator 602 detects that the chopping point of rectified phase control input voltage $V_{\Phi_RECT}$ has been reached. Since the frequency of rectified phase control input voltage $V_{\Phi_RECT}$ and the frequency of clock signal $f_{clk}$ is known, in at least one embodiment, duty cycle detector 604 determines the duty cycle of rectified phase control input voltage $V_{\Phi_RECT}$ in accordance with exemplary Equation [1] from the count of cycles of clock signal $f_{clk}$ that occur until comparator 602 detects the chopping point of dimmer output signal $V_{DIM}$:

$$DCYCLE = \frac{1}{f_{V\Phi_RECT}} - \left(CNT \cdot \frac{1}{f_{clk}}\right), \quad [1]$$

where $1/f_{V\Phi_RECT}$ represents the period of rectified phase control input voltage $V_{\Phi_RECT}$, CNT represents the number of cycles of clock signal $f_{clk}$ that occur until the comparator 602 detects that the chopping point of rectified phase control input voltage $V_{\Phi_RECT}$ has been reached, and $1/f_{clk}$ represents the period of the clock signal CLK.

Encoder 606 encodes digital duty cycle signal DCYCLE into dimming information $D_I$. The particular configuration of encoder 606 is a matter of design choice and depends on, for example, the signal type and protocol for which lamp ballast 310 is designed to receive. In at least one embodiment, encoder 606 is a digital-to-analog converter that encodes digital duty cycle signal DCYCLE as an analog voltage ranging from 0-10V. In at least one embodiment, encoder 606 is a pulse width modulator that encodes digital duty cycle signal DCYCLE as a pulse width modulated signal $D_I$ having a pulse value ranging from 0-127. In other embodiments, encoder 606 is configured to encode digital duty cycle signal DCYCLE as a DALI signal $D_I$ or an $I^2C$ signal $D_I$. Converter 600 can be implemented in software as instructions executed by a processor (not shown) of controller 604, as hardware, or as a combination of hardware and software.

Referring to FIG. 5, lighting system 508, which represents one embodiment of lighting system 308 (FIG. 3), includes ballast 510, and ballast 510 represents one embodiment of ballast 310 (FIG. 3). Controller 504 provides the dimming information $D_I$ to ballast controller 506 of ballast 510. In at least one embodiment, ballast controller 506 is a conventional integrated circuit that receives dimming information $D_I$ and generates lamp control signals $L_0$ and $L_1$. Lamp control signal $L_0$ controls conductivity of n-channel field effect transistor (FET) 512, and lamp control signal $L_1$ controls conductivity of n-channel FET 514. Ballast controller 506 controls the frequency of lamp control signals $L_0$ and $L_1$ to regulate current $i_{LAMP}$ of capacitor 516 and inductor 518 to an approximately constant value. Capacitor 516 and inductor 518 conduct lamp current $i_{LAMP}$.

The dimming information $D_I$ represents a light intensity level for lamp 312. As previously discussed, in at least one embodiment, the dimming information $D_I$ represents a light intensity level derived from a conduction angle of the rectified input voltage $V_{\Phi_RECT}$ as determined by controller 504. In at least one embodiment, to increase the intensity of lamp 312, ballast controller increases a duty cycle of lamp control signal $L_0$ and decreases a duty cycle of lamp control signal $L_1$. Conversely, to decrease the intensity of lamp 312, ballast controller 506 decreases a duty cycle of lamp control signal $L_0$ and increases a duty cycle of lamp control signal $L_1$. ("Duty cycle" refers to a ratio pulse duration to a period of a signal.) Capacitor 520 provides high frequency filtering. The component values of power control/lighting system 500 are a matter of design choice and depend, for example, on the desired link voltage $V_{LINK}$ and power requirements of lighting system 508.

Controller 504 also utilizes sampled versions of the rectified input voltage $V_{\Phi_RECT}$ and the link voltage $V_{LINK}$ to generate switch control signal $CS_1$. In at least one embodiment, controller 504 generates switch control signal $CS_1$ in the same manner as controller 302 generates control signal $CS_0$. Controller 504 monitors the rectified input voltage $V_{\Phi_RECT}$ and the link voltage $V_{LINK}$. Controller 504 generates control signal $CS_1$ to control conductivity of switch 506 in order to provide power factor correction and regulate link voltage $V_{LINK}$. During PFC mode, controller 504 provides power factor correction for switching power converter 502 after any phase delay $\alpha$ of input voltage $V_{\Phi_RECT}$. (A phase delay $\alpha$ of 0 indicates an absence of dimming). Control of power factor correction and the output voltage $V_{OUT}$ of switching power converter 102 is, for example, described in the exemplary embodiments of Melanson I, II, III, IV, V, and VI.

In at least one embodiment, controller 504 has two modes of controlling switching power converter 502, PFC mode and maintenance mode. Controller 502 operates in PFC mode during each cycle of rectified input voltage $V_{\Phi_RECT}$ to provide power factor correction as previously described. During any phase delay $\alpha$ of input voltage $V_{\Phi_RECT}$, controller 504 operates in maintenance mode.

When supplying a reactive load, such as switching power converter 502, the phase control dimmer 305 can miss generating phase delays a in some cycles of phase modulated signal $V_{\Phi_DIM}$ and can generate ripple during the phase delays $\alpha$. Missing phase delays $\alpha$ and ripple during phase delays a can cause errors in determining the value of duty cycle signal DCYCLE. During maintenance mode, controller 504 causes switching power converter 502 to have an input resistance that allows phase control dimmer 305 to generate rectified input voltage $V_{\Phi_RECT}$ with a substantially uninterrupted phase delay $\alpha$ during each half-cycle of the input voltage $V_{\Phi_RECT}$ during the dimming period. In at least one embodiment, controller 504 establishes an input resistance of switching power converter 502 during the maintenance mode that allows phase control dimmer 305 to phase modulate the supply voltage $V_{IN}$ so that rectified input voltage $V_{\Phi_RECT}$ has a single, uninterrupted phase delay during each half cycle of the input voltage $V_{\Phi_RECT}$. A complete discussion of exemplary operation of controller 504 in PFC mode and maintenance mode is described in Melanson VI.

Figure 7:
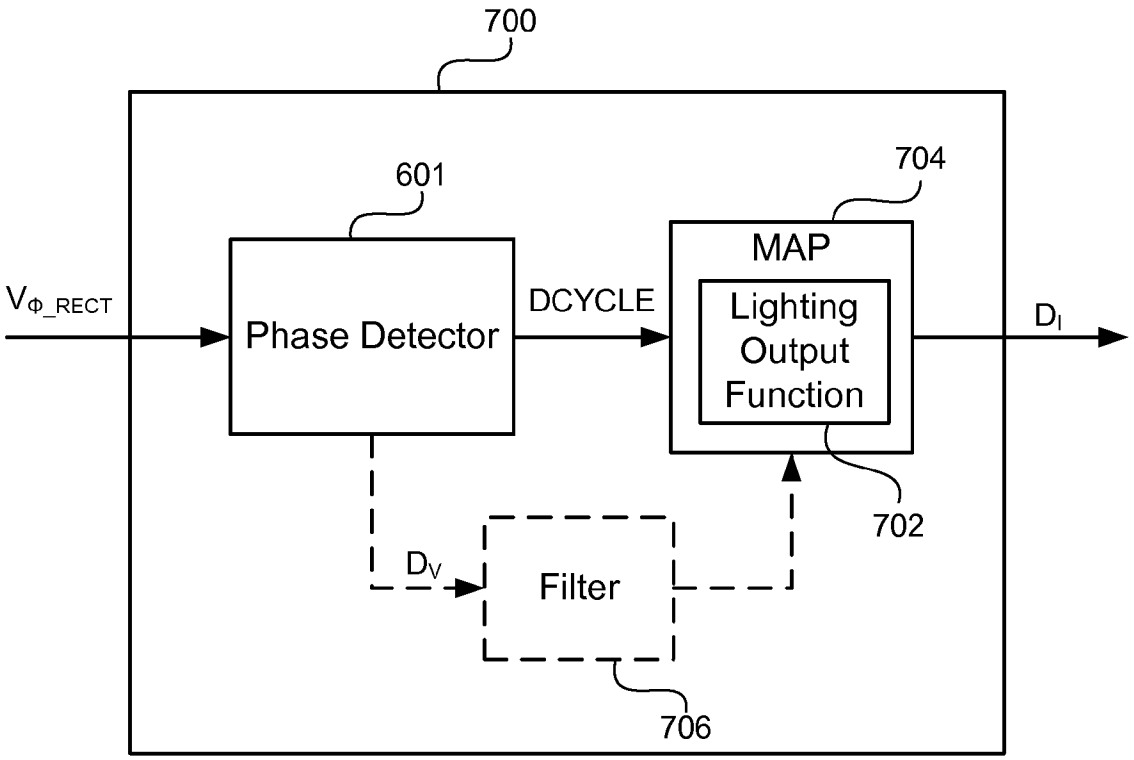
FIG. 7 depicts another embodiment of a converter that converts a phase modulated, rectified phase control input voltage into dimming information using a lighting output function.

FIG. 7 depicts converter 700, which represents another embodiment of converter 505. Converter 700 includes phase detector 601 to generate dimmer output duty cycle signal DCYCLE. A mapping module 704 includes a lighting output function 702 to map rectified phase control input voltage $V_{\Phi_RECT}$ to dimmer information $D_I$.

The particular mapping of lighting output function 702 is a matter of design choice, which provides flexibility to converter 700 to map the light intensity level indicated by the conduction angle of rectified phase control input voltage $V_{\Phi_RECT}$ to any light intensity level. For example, in at least one embodiment, the lighting output function 704 maps values of the duty cycle signal DCYCLE to a human perceived lighting output levels with, for example, an approximately linear relationship. The lighting output function 702 can also map values of the duty cycle signal DCYCLE to other lighting functions. For example, the lighting output function 702 can map a particular duty cycle signal DCYCLE to a timing signal that turns lamp 312 (FIG. 3) "off" after a predetermined amount of time if the duty cycle signal DCYCLE does not change during a predetermined amount of time.

The lighting output function 702 can map dimming levels represented by values of a dimmer output signal to a virtually unlimited number of functions. For example, lighting output function 702 can map a low percentage dimming level, e.g. 90% dimming, to a light source flickering function that causes the lamp 312 to randomly vary in intensity for a predetermined dimming range input. In at least one embodiment, the intensity of lamp 312 results in a color temperature of no more than 2500 K. Controller 504 can cause lamp 312 to flicker by generating dimming information $D_I$ to provide random dimming information to lamp ballast 310.

In one embodiment, conduction angles of rectified phase control input voltage $V_{\Phi_RECT}$ represent duty cycles of rectified phase control input voltage $V_{\Phi_RECT}$ corresponding to an intensity range of lamp 312 of approximately 95% to 10%. The lighting output function maps the conduction angles of rectified phase control input voltage $V_{\Phi_RECT}$ to provide an intensity range of the lamp 312 of greater than 95% to less than 5%.

The implementation of mapping module 704 and the lighting output function 702 are a matter of design choice. For example, the lighting output function 702 can be predetermined and embodied in a memory. The memory can store the lighting output function 702 in a lookup table. For each dimmer output signal value of duty cycle signal DCYCLE, the lookup table can include one or more corresponding dimming values represented by dimming information $D_I$. In at least one embodiment, the lighting output function 702 is implemented as an analog function generator that correlates conduction angles of rectified phase control input voltage $V_{\Phi_RECT}$ to dimming values represented by dimming information $D_I$.

Figure 8:
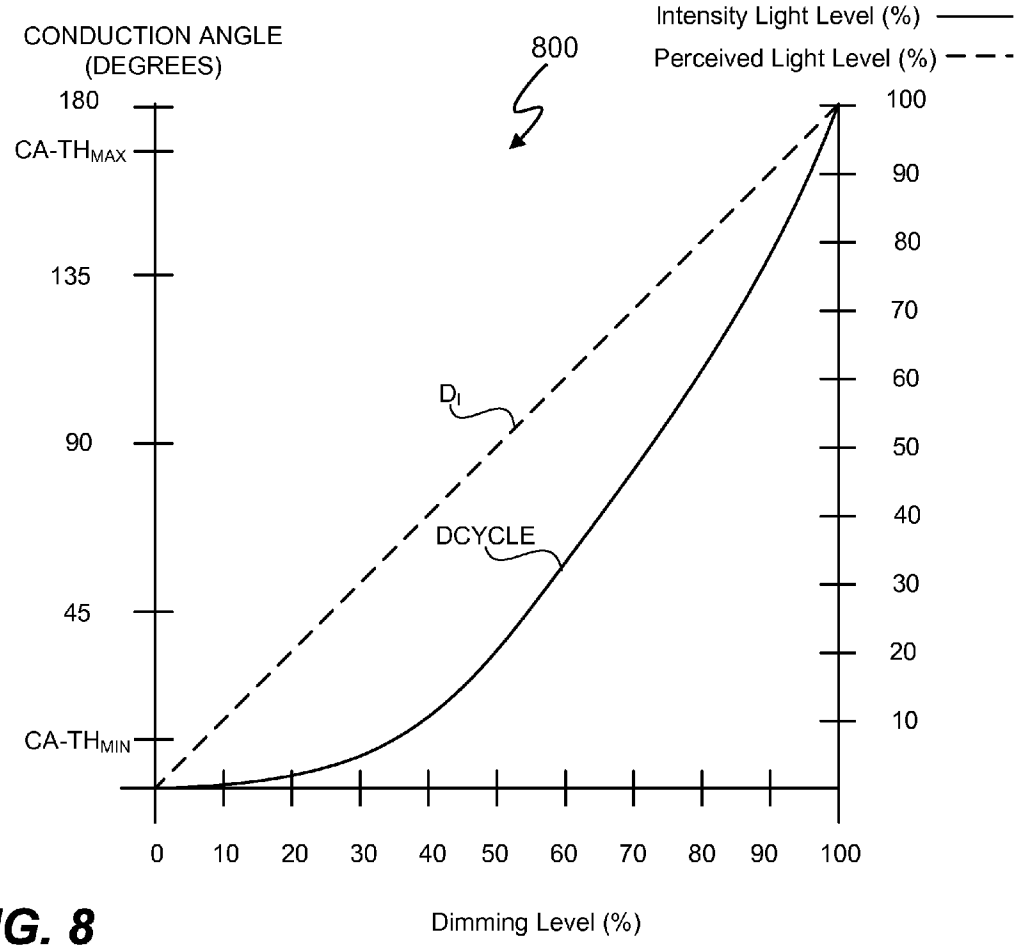
FIG. 8 depicts a graphical depiction of an exemplary lighting output function of FIG. 7.

FIG. 8 depicts a graphical depiction 800 of an exemplary lighting output function 702. Conventionally, as measured light percentage changes from 10% to 0%, human perceived light changes from about 32% to 0%. The exemplary lighting output function 702 maps the light intensity percentage as specified by the duty cycle signal DCYCLE to dimming information $D_I$ that provides a linear relationship between perceived light percentages and dimming level percentages. Thus, when the conduction angle of rectified phase control input voltage $V_{\Phi_RECT}$ indicates a dimming level of 50%, the perceived light percentage is also 50%, and so on. By providing a linear relationship, the exemplary lighting output function 702 provides the phase control dimmer 305 with greater sensitivity at high dimming level percentages.

Figure 9:
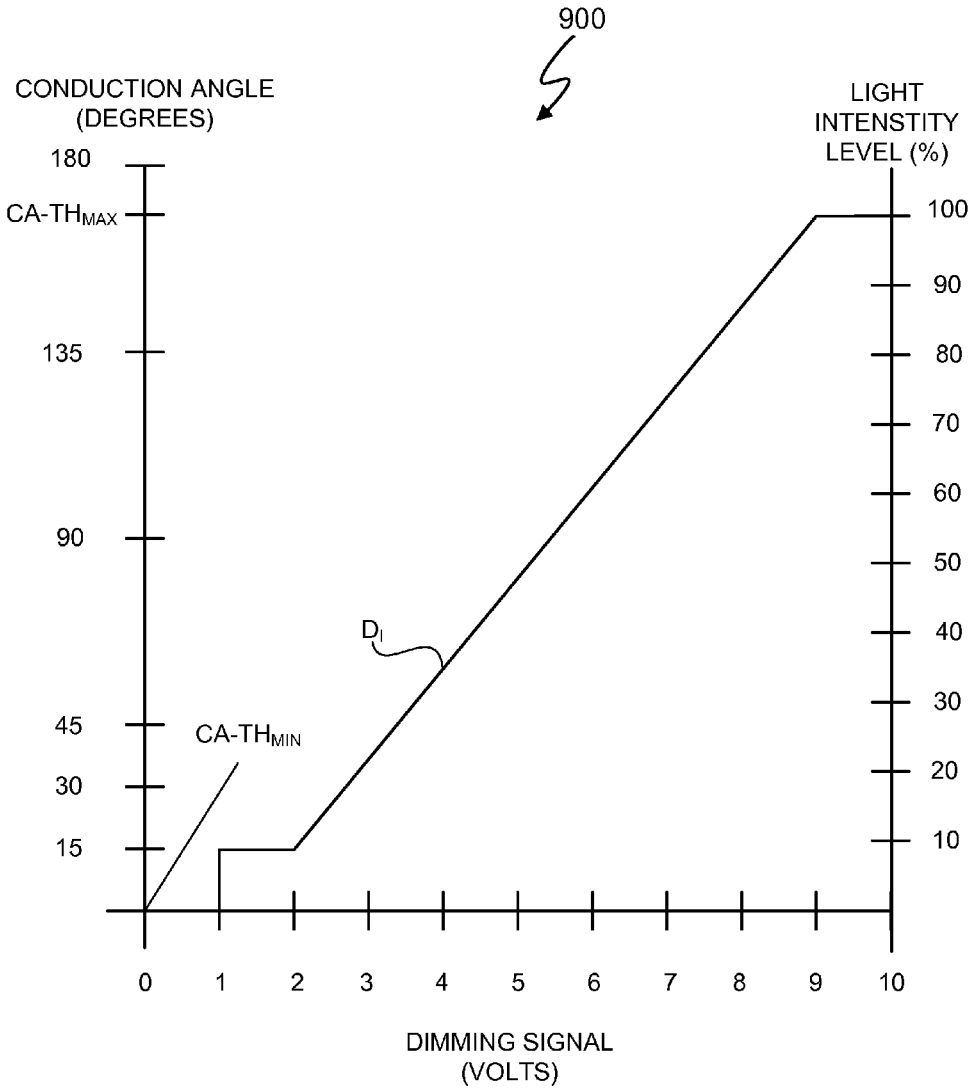
FIG. 9 depicts another graphical depiction of an exemplary lighting output function of FIG. 7.

FIG. 9 depicts a graphical representation 900 of an exemplary lighting output function in-rush current protection module 702, which represents an estimation of normal operation of phase control dimmer 305 that protects lamp 312 (FIG. 3) from oscillations of rectified phase control input voltage $V_{\Phi_RECT}$ at low conduction angles and potential errors in high conduction angles. Phase control dimmer 305 maps conduction angles of rectified phase control input voltage $V_{\Phi_RECT}$ to a light intensity level ranging from about 8% to 100%. For conduction angles ranging from 0 to a minimum conduction angle threshold CA-$TH_{MIN}$ of, for example, about 0°, mapping function 702 maps dimming information $D_I$ equal to 0V. Mapping conduction angles of 0-15° prevents random oscillations of lamp 312 that could occur as a result of inaccuracies in phase control dimmer 305. For conduction angles of rectified phase control input voltage $V_{\Phi_RECT}$ between about 15° and 30°, lighting output function 702 maps rectified phase control input voltage $V_{\Phi_RECT}$ to dimming information $D_I$ equal to 1V. For conduction angles of rectified phase control input voltage $V_{\Phi_RECT}$ between 30° and to a maximum conduction angle threshold CA-$TH_{MAX}$ of 170°, lighting output function 702 linearly maps the conduction angles to values of dimming information $D_I$ ranging from 1V and 10V.

Referring to FIG. 7, a signal processing function can be applied in converter 700 to alter transition timing from a first light intensity level to a second light intensity level. The function can be applied before or after mapping with the lighting output function 702. In at least one embodiment, the signal processing function is embodied in a filter 706. When using filter 706, filter 706 processes the duty cycle signal DCYCLE prior to passing the filtered duty cycle signal DCYCLE to mapping module 704. The conduction angles of rectified phase control input voltage $V_{\Phi_RECT}$ can change abruptly, for example, when a switch on phase control dimmer 305 is quickly transitioned from 90% dimming level to 0% dimming level. Additionally, rectified phase control input voltage $V_{\Phi_RECT}$ can contain unwanted perturbations caused by, for example, fluctuations in line voltage $V_{IN}$.

Filter 706 can represent any function that changes the dimming levels specified by the duty cycle signal DCYCLE. For example, in at least one embodiment, filter 706 filters the duty cycle signal DCYCLE with a low pass averaging function to obtain a smooth dimming transition. In at least one embodiment, abrupt changes from high dimming levels to low dimming levels are desirable. Filter 706 can also be configured to smoothly transition low to high dimming levels while allowing an abrupt or much faster transition from high to low dimming levels. Filter 706 can be implemented with analog or digital components. In another embodiment, the filter filters the dimming information $D_I$ to obtain the same results.

Thus, in at least one embodiment, a power control/lighting system includes a controller to provide compatibility between a lamp ballast configured to receive a dedicated dimmers signal and a phase control dimmer.

Although the present invention has been described in detail, it should be understood that various changes, substitutions and alterations can be made hereto without departing from the spirit and scope of the invention as defined by the appended claims.

What is claimed is:

1. An apparatus comprising:

a first controller having an input to receive a phase control dimming signal, wherein the phase control dimming signal is a signal representing a conduction angle generated by a dimmer and the conduction angle corresponds to a phase delay of a supply input voltage to a switching power converter, and the controller is configured to: (i) convert the phase control dimming signal into dimming information and (ii) generate a power factor correction (PFC) control signal for a switching power converter, wherein the first controller further includes a first output to provide the dimming information to a second controller to allow the second controller to control generation of power control signals that control conductivity of one or more switches in accordance with the dimming information and a second output to provide the PFC control signal.

2. The apparatus of claim 1 wherein the first controller comprises an integrated circuit and the input, first output, and second output comprise pins of the integrated circuit.

3. The apparatus of claim 1 wherein the dimming information is a member of a group consisting of: a pulse width modulated signal, a linear voltage signal, a nonlinear voltage signal, a digital addressable lighting interface protocol signal, and an inter-integrated circuit ($I^2C$) protocol signal.

4. The apparatus of claim 1 wherein the phase control dimming signal has a conduction angle generated by a member of a group consisting of:

a bidirectional triode thyristor (triac)-based circuit and a transistor based circuit.

5. The apparatus of claim 1 wherein to convert the phase control dimming signal into dimming information, the first controller is further configured to:

detect a duty cycle of the phase control dimming signal;

generate a dimming signal value indicating the duty cycle; and convert the dimming signal value into the dimming information.

6. The apparatus of claim 1 wherein to convert the phase control dimming signal into dimming information, the first controller is further configured to:

detect duty cycles of the phase control dimming signal;

convert the duty cycles of the phase control dimming signal into digital data representing the detected duty cycles, wherein the digital data correlates to light intensity levels; and map the digital data to values of the control signal using a predetermined lighting output function.

7. The apparatus of claim 1 wherein the phase control dimming signal is a time varying voltage generated by a triac-based dimmer, the switching power converter includes a switch having a control terminal to receive the PFC control signal to control voltage conversion of the phase control dimming signal, and the first controller is further configured to:

establish an input resistance of the switching power converter during a dimming portion of the phase control dimming signal, wherein the input resistance allows the triac-based dimmer to generate the phase control dimming signal with a substantially uninterrupted phase delay during each half-cycle of the phase control dimming signal during a dimming period.

8. The apparatus of claim 1 wherein to convert the phase control dimming signal into dimming information, the first controller is further configured to:

map the phase control dimming signal to the dimming information using a predetermined lighting output function.

9. The apparatus of claim 8 wherein the predetermined lighting output function is configured to map the phase control dimming signal to a light intensity level different than a light intensity level indicated by a conduction angle of the phase control dimming signal.

10. The apparatus of claim 1 wherein the first controller is configured to control a supply of power factor corrected power to a discharge-type lighting system and provide the dimming information for the discharge-type lighting system.

11. A method comprising:

receiving a phase control dimming signal, wherein the phase control dimming signal is a signal representing a conduction angle generated by a dimmer and the conduction angle corresponds to a phase delay of a supply input voltage to a switching power converter;

converting the phase control dimming signal into dimming information in a first controller for a second controller of a lighting system to allow the second controller to control generation of power control signals that control conductivity of one or more switches in accordance with the dimming information; and generating a power factor correction (PFC) control signal in the first controller for a switching power converter.

12. The method of claim 11 wherein the dimming information is a member of a group consisting of: a pulse width modulated signal, a linear voltage signal, a nonlinear voltage signal, a digital addressable lighting interface protocol signal, and an inter-integrated circuit ($I^2C$) protocol signal.

13. The method of claim 11 wherein the phase control dimming signal has a conduction angle generated by a member of a group consisting of:

a bidirectional triode thyristor (triac)-based circuit and a transistor based circuit.

14. The method of claim 11 wherein converting the phase control dimming signal into dimming information for a lighting system comprises:

detecting a duty cycle of the phase control dimming signal;

generating a dimming signal value indicating the duty cycle; and converting the dimming signal value into the dimming information.

15. The method of claim 11 wherein converting the phase control dimming signal into dimming information for a lighting system comprises:

detecting duty cycles of the phase control dimming signal;

converting the duty cycles of the phase control dimming signal into digital data representing the detected duty cycles, wherein the digital data correlates to light intensity levels; and mapping the digital data to values of the control signal using a predetermined lighting output function.

16. The method of claim 11 wherein the phase control dimming signal is a time varying voltage generated by a triac-based dimmer, the method further comprises:

establish an input resistance of the switching power converter during a dimming portion of the phase control dimming signal, wherein the input resistance allows the triac-based dimmer to generate the phase control dimming signal with a substantially uninterrupted phase delay during each half-cycle of the phase control dimming signal during a dimming period.

17. The method of claim 11 wherein converting the phase control dimming signal into dimming information for a lighting system comprises:

mapping the phase control dimming signal to the dimming information using a predetermined lighting output function.

18. The method of claim 17 wherein mapping the phase control dimming signal to the dimming information using a predetermined lighting output function comprises mapping the phase control dimming signal to a light intensity level different than a light intensity level indicated by a conduction angle of the phase control dimming signal.

19. The method of claim 11 further comprising:

providing the PFC control signal to the switching power converter to control power factor correction and output voltage regulation of the switching power converter.

20. The method of claim 11 further comprising:

providing the dimming information to a lighting system.

21. The method of claim 20 wherein providing the dimming information to a lighting system comprises:

providing the dimming information to a discharge-type lighting system.

22. A power control/lighting system comprising:

a switching power converter having at least one input to receive a phase control dimming signal, wherein the phase control dimming signal is a signal representing a conduction angle generated by a dimmer and the conduction angle corresponds to a phase delay of a supply input voltage to a switching power converter;

a first controller having an input to receive the phase control dimming signal, wherein the controller is configured to: (i) convert the phase control dimming signal into dimming information and (ii) generate a power factor correction (PFC) control signal for a switching power converter, wherein the first controller further includes a first output to provide the dimming information to a second controller to allow the second controller to control generation of power control signals that control conductivity of one or more switches in accordance with the dimming information and a second output coupled to the switching power converter to provide the PFC control signal;

a lamp ballast coupled to the switching power converter and the second output of the controller; and a discharge-type lamp coupled to the lamp ballast.

23. The power control/lighting system of claim 22 wherein the first controller comprises an integrated circuit and the input, first output, and second output comprise pins of the integrated circuit.

24. The power control/lighting system of claim 22 wherein the dimming information is a member of a group consisting of: a pulse width modulated signal, a linear voltage signal, a nonlinear voltage signal, a digital addressable lighting interface protocol signal, and an inter-integrated circuit ($I^2C$) protocol signal.

25. The power control/lighting system of claim 22 wherein the phase control dimming signal has a conduction angle generated by a member of a group consisting of: a bidirectional triode thyristor (triac)-based circuit and a transistor based circuit.

26. The power control/lighting system of claim 22 wherein to convert the phase control dimming signal into dimming information, the first controller is further configured to:

detect a duty cycle of the phase control dimming signal;

generate a dimming signal value indicating the duty cycle; and convert the dimming signal value into the dimming information.

27. The power control/lighting system of claim 22 wherein to convert the phase control dimming signal into dimming information, the first controller is further configured to:

detect duty cycles of the phase control dimming signal;

convert the duty cycles of the phase control dimming signal into digital data representing the detected duty cycles, wherein the digital data correlates to light intensity levels; and map the digital data to values of the control signal using a predetermined lighting output function.

28. The power control/lighting system of claim 22 wherein the phase control dimming signal is a time varying voltage generated by a triac-based dimmer, the switching power converter includes a switch having a control terminal to receive the PFC control signal to control voltage conversion of the phase control dimming signal, and the first controller is further configured to:

establish an input resistance of the switching power converter during a dimming portion of the phase control dimming signal, wherein the input resistance allows the triac-based dimmer to generate the phase control dimming signal with a substantially uninterrupted phase delay during each half-cycle of the phase control dimming signal during a dimming period.

29. The power control/lighting system of claim 22 wherein to convert the phase control dimming signal into dimming information, the first controller is further configured to:

map the phase control dimming signal to the dimming information using a predetermined lighting output function.

30. The power control/lighting system of claim 29 wherein the predetermined lighting output function is configured to map the phase control dimming signal to a light intensity level different than a light intensity level indicated by a conduction angle of the phase control dimming signal.

* * * * *